US007744301B2

(12) United States Patent
Fatemi

(10) Patent No.: US 7,744,301 B2
(45) Date of Patent: Jun. 29, 2010

(54) SPREAD-STYLE COUPLER WITH SUPPLEMENTAL LOCK SYSTEM

(75) Inventor: Ray S. Fatemi, Fairlawn, OH (US)

(73) Assignee: Attachment Technologies, Inc., Cedar Rapids, IA (US)

( * ) Notice: Subject to any disclaimer, the term of this patent is extended or adjusted under 35 U.S.C. 154(b) by 0 days.

(21) Appl. No.: 12/001,326

(22) Filed: Dec. 10, 2007

(65) Prior Publication Data

US 2008/0175657 A1 Jul. 24, 2008

Related U.S. Application Data

(60) Division of application No. 11/059,983, filed on Feb. 17, 2005, now Pat. No. 7,306,395, and a continuation-in-part of application No. 10/305,610, filed on Nov. 27, 2002, now Pat. No. 6,881,002.

(60) Provisional application No. 60/545,432, filed on Feb. 17, 2004, provisional application No. 60/405,398, filed on Aug. 23, 2002, provisional application No. 60/333,989, filed on Nov. 29, 2001.

(51) Int. Cl.
*E02F 3/96* (2006.01)

(52) U.S. Cl. ..... 403/322.1; 403/322.3; 172/272; 37/468; 414/723

(58) Field of Classification Search ..... 403/321, 403/322.1, 322.3; 172/272; 37/468; 414/705, 414/723

See application file for complete search history.

(56) References Cited

U.S. PATENT DOCUMENTS 4,761,113 A 8/1988 Smith et al.
5,082,389 A 1/1992 Balemi
5,141,385 A 8/1992 Tibbatts et al.
5,179,794 A * 1/1993 Ballinger ..... 37/468
5,382,110 A 1/1995 Perotto et al.
5,423,625 A 6/1995 Gebauer et al.
5,456,030 A * 10/1995 Barone et al. ..... 37/468

(Continued)

FOREIGN PATENT DOCUMENTS

EP 1 039 040 9/2000

(Continued)

OTHER PUBLICATIONS

Annex to Form PCT/ISA/206 for International Application No. PCT/US02/38165.

*Primary Examiner*—Michael P Ferguson
(74) *Attorney, Agent, or Firm*—Fay Sharpe LLP

(57) ABSTRACT

A coupler includes a first hook assembly comprising a first hook adapted to receive a first associated attachment pin and a second hook assembly comprising a second hook adapted to receive a second associated attachment pin. The second hook assembly selectively pivots under force of an actuator relative to the first hook assembly by an actuator. The actuator comprises a screw jack that includes a locking sleeve to prevent unintended rotation of the screw member. The actuator can be a hydraulic cylinder and the coupler can include a locking cam that moves between a retracted position and an extended position, with a supplemental lock that selectively prevents movement of the locking cam from the extended position to the retracted position. In such case, the actuator is operatively coupled to the second hook assembly and the locking cam.

8 Claims, 25 Drawing Sheets

U.S. PATENT DOCUMENTS

| | | | |
|---|---|---|---|
| 5,549,440 | A | 8/1996 | Cholakon et al. |
| 5,692,325 | A | 12/1997 | Kuzutani |
| 6,058,633 | A | 5/2000 | Barden |
| 6,132,131 | A | 10/2000 | Nakamura et al. |
| 6,203,236 | B1 | 3/2001 | Gautier et al. |
| 6,233,852 | B1 | 5/2001 | Pemberton |
| 6,379,075 | B1 | 4/2002 | Shamblin et al. |
| 6,422,805 | B1 | 7/2002 | Miller |
| 6,481,124 | B1 | 11/2002 | Miller et al. |
| 6,508,616 | B2 | 1/2003 | Hung |
| 6,629,811 | B1 | 10/2003 | Husson |
| 6,881,002 | B2 | 4/2005 | Fatemi |
| 6,902,346 | B2 | 6/2005 | Steig, Jr. et al. |
| 6,964,122 | B2 | 11/2005 | Cunningham et al. |
| 6,996,926 | B2 | 2/2006 | Fatemi |
| 2001/0050326 | A1 | 12/2001 | Muroto |
| 2002/0136597 | A1 | 9/2002 | Nishikawa et al. |

FOREIGN PATENT DOCUMENTS

| | | |
|---|---|---|
| JP | 7-331690 | 12/1995 |
| JP | 11-181818 | 7/1999 |
| JP | 2000248752 | 9/2000 |
| WO | WO 01/81682 | 11/2001 |

* cited by examiner

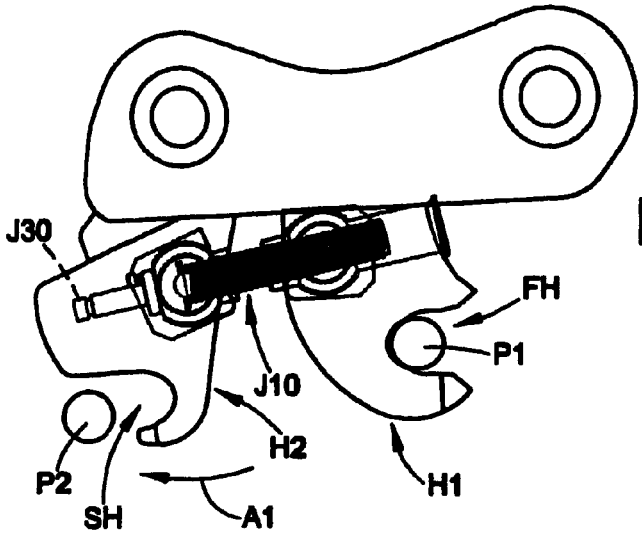
FIG. 12A
FIG. 12B
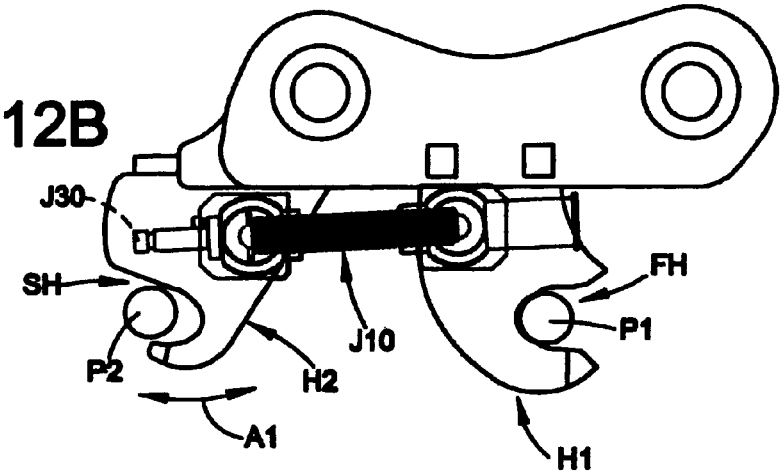
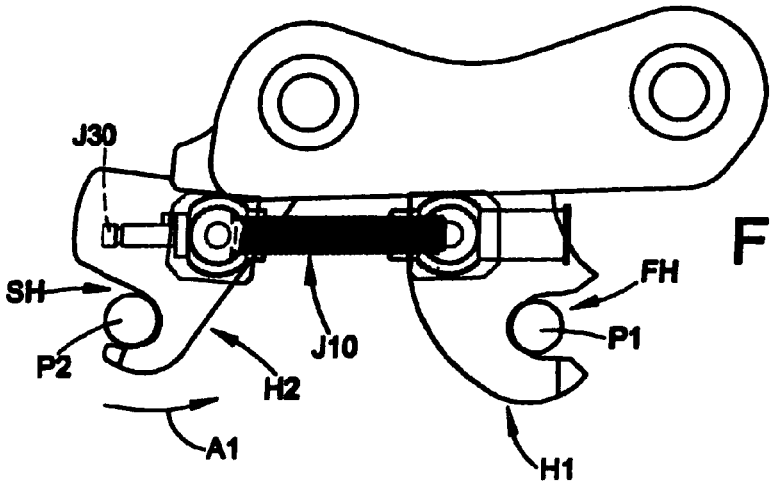
FIG. 12C

SPREAD-STYLE COUPLER WITH SUPPLEMENTAL LOCK SYSTEM

CROSS-REFERENCE TO RELATED APPLICATION

This application is a divisional of U.S. application Ser. No. 11/059,983 filed Feb. 17, 2005, now U.S. Pat. No. 7,306,395, which claims benefit of the filing date of U.S. provisional application Ser. No. 60/545,432 filed Feb. 17, 2004, and which is a continuation-in-part of U.S. application Ser. No. 10/305,610 filed Nov. 27, 2002, now U.S. Pat. No. 6,881,002, which claims benefit of the filing date of U.S. provisional application Ser. No. 60/405,398 filed Aug. 23, 2002 and U.S. provisional application Ser. No. 60/333,989 filed Nov. 29, 2001, and all of said prior applications are hereby expressly incorporated by reference herein.

BACKGROUND OF THE INVENTION

The present invention relates to couplers used to secure attachments such as buckets, impact hammers, shears, etc. fixedly and operatively to the distal end of an arm of a tractor, backhoe, excavator or other type of arm-equipped construction/agricultural equipment. As is generally well known, couplers, also referred to as "quick couplers," are used as an alternative to a pin-on connection for fixedly and operatively securing an attachment to the distal end of an arm which is, in turn, secured to a boom of a construction/agricultural machine such as a backhoe or excavator.

Spread-style couplers are generally known. These couplers are connected to an arm by a pin-on connection at a first pivot point and are connected to a control link by a pin-on connection at a second pivot point. These prior couplers include first and second hooks that open in opposite directions oriented outwardly away from each other. In use, the hooks are collapsed toward each other are placed between first and second pins of a bucket or other attachment and the hooks are then spread-apart from each other, using a screw jack, hydraulic cylinder or other means. Upon being spread sufficiently far apart, the first hook engages the first pin of the attachment and the second hook engages the second pin of the attachment which results in the attachment being operatively connected to the arm.

It has been deemed desirable to provide a spread-style coupler with a supplemental lock system that prevents undesired attachment decoupling when the coupler is not located in a proper decoupling position. Specifically, for safety, it has been deemed desirable to provide a spread-style coupler with a mechanical supplemental lock system that prevents attachment decoupling unless the coupler is curled sufficiently relative to the machine arm so that the attachment cannot fall uncontrollably from the coupler upon movement of the first and second hooks inwardly toward each other.

SUMMARY OF THE INVENTION

In accordance with a first aspect of the present development, a coupler comprises: an upper portion defining a first pin on axis and a second pin-on axis; a first hook assembly comprising a first hook adapted to receive a first associated attachment pin; a second hook assembly comprising a second hook adapted to receive a second associated attachment pin, the second hook assembly pivotally connected to the upper portion and selectively pivotable toward and away from the first hook assembly; a locking cam that moves between a retracted position and an extended position, wherein the locking cam at least partially blocks the first hook when in the extended position; an actuator operatively connected between the second hook assembly and the locking cam, the actuator being operable between a first position and a second position, wherein: (i) when the actuator is operated from the first position to the second position, the actuator moves the second hook away from the first hook and moves the locking cam from the retracted position to the extended position; and, (ii) when the actuator is operated from the second position to the first position, the actuator moves the second hook toward the first hook and moves the locking cam from the extended position to the retracted position; a stop; and, a pendulum lock bar movably connected to the locking cam and movable under force of gravity between a locked position and an unlocked position depending upon an angular orientation of the coupler, wherein: (i) said pendulum lock bar is located to engage the stop and prevent movement of the locking cam from the extended position to the retracted position when the pendulum lock bar is located in the locked position; and, (ii) the pendulum lock bar is moved out of alignment with the stop when the pendulum lock bar is located in the unlocked position so that the locking cam is movable from the extended position to the retracted position when said pendulum lock bar is in the unlocked position.

In accordance with another aspect of the present development, a coupler comprises: first and second spaced-apart ribs each defining first and second bores, the first bore of the first rib aligned with the first bore of the second rib on a first pin-on axis, and the second bore of the first rib aligned with the second bore of the second rib on a second pin-on axis; a first hook assembly comprising a first hook adapted to receive a first associated attachment pin; a second hook assembly comprising a second hook adapted to receive a second associated attachment pin, the second hook assembly selectively pivotable relative to the first and second ribs toward and away from the first hook assembly; a screw jack assembly actuator operatively connected to the second hook assembly and adapted to pivot the second hook assembly selectively relative to the first and second ribs, wherein the screw jack assembly comprises: (i) a rotatable screw member comprising a driving head adapted for driving connection with a manual tool; (ii) a locking sleeve that is movable from an extended position to a depressed position and biased into said extended position, wherein the locking sleeve engages the screw member and restrains the screw member against rotation when the locking sleeve is in the extended position.

In accordance with a further aspect of the present development, a coupler comprises an upper portion defining a first pin on axis and a second pin-on axis; a first hook assembly comprising a first hook adapted to receive a first associated attachment pin; a second hook assembly comprising a second hook adapted to receive a second associated attachment pin, the second hook assembly pivotally connected to the upper portion and selectively pivotable about the second pin-on axis toward and away from the first hook assembly; a locking cam that moves between a retracted position and an extended position, wherein the locking cam at least partially blocks the first hook when in the extended position; an actuator operatively engaged with the second hook assembly and the locking cam, the actuator being operable between a first position and a second position, wherein: (i) when the actuator is operated from the first position to the second position, the actuator moves the second hook away from the first hook and moves the locking cam from the retracted position to the extended position; and, (ii) when the actuator is operated from the second position to the first position, the actuator moves the second hook toward the first hook and moves the locking cam from the extended position to the retracted position; supplemental lock means for mechanically blocking movement of the locking cam from the extended position to the retracted position under force of the actuator when the coupler is in a first angular orientation relative to the first pin-on axis and for allowing movement of the locking cam from the extended position to the retracted position under force of the actuator when the coupler is in a second angular orientation relative to the first pin-on axis.

In accordance with another aspect of the present development, a coupler comprises a first hook assembly comprising a first hook adapted to receive a first associated attachment pin; a second hook assembly comprising a second hook adapted to receive a second associated attachment pin, the second hook assembly pivotally connected to the upper portion and selectively pivotable about the second pin-on axis toward and away from said first hook assembly; a locking cam that moves between a retracted position and an extended position, wherein the locking cam at least partially blocks the first hook when in the extended position; an actuator operatively coupled to the second hook assembly and the locking cam, the actuator being operable between a first position and a second position, wherein: (i) when the actuator is operated from the first position to the second position, the actuator moves the second hook away from the first hook and moves the locking cam from the retracted position to the extended position; and, (ii) when the actuator is operated from the second position to the first position, the actuator moves the second hook toward the first hook and moves the locking cam from the extended position to the retracted position; a pendulum lock bar that swings under force of gravity between a locked position where it blocks movement of the locking cam from the extended position to the retracted position and an unlocked position where it has no effect on movement of the locking cam from the extended position to the retracted position.

In accordance with another aspect of the development, a coupler comprises: a first hook assembly comprising a first hook adapted to receive a first associated attachment pin; a second hook assembly comprising a second hook adapted to receive a second associated attachment pin, wherein the second hook assembly selectively pivots relative to the first hook assembly; an actuator for moving the second hook assembly relative to the first hook assembly, wherein the actuator comprises one of: a screw jack assembly that includes a rotatable screw member and a locking sleeve that selectively engages the rotatable screw to prevent unintended rotation of the rotatable screw member; and, a hydraulic cylinder operably connected between the second hook assembly and a locking cam, wherein the locking cam moves between a retracted position and an extended position and obstructs the first hook when in the extended position, and a supplemental lock that prevents movement of the locking cam from the extended position to the retracted position for all but at least one select angular orientation of the coupler.

BRIEF DESCRIPTION OF THE DRAWINGS

The invention comprises various components and arrangements of components, preferred embodiments of which are illustrated in the accompanying drawings that form a part hereof and wherein:

FIGS. 12A-12C are side views of the coupler shown in FIGS. 1 & 2 and respectively illustrate the coupler in first, second and third operative positions relative to two associated pins of an associated bucket or other attachment;

DETAILED DESCRIPTION OF PREFERRED EMBODIMENTS

Figure 1:
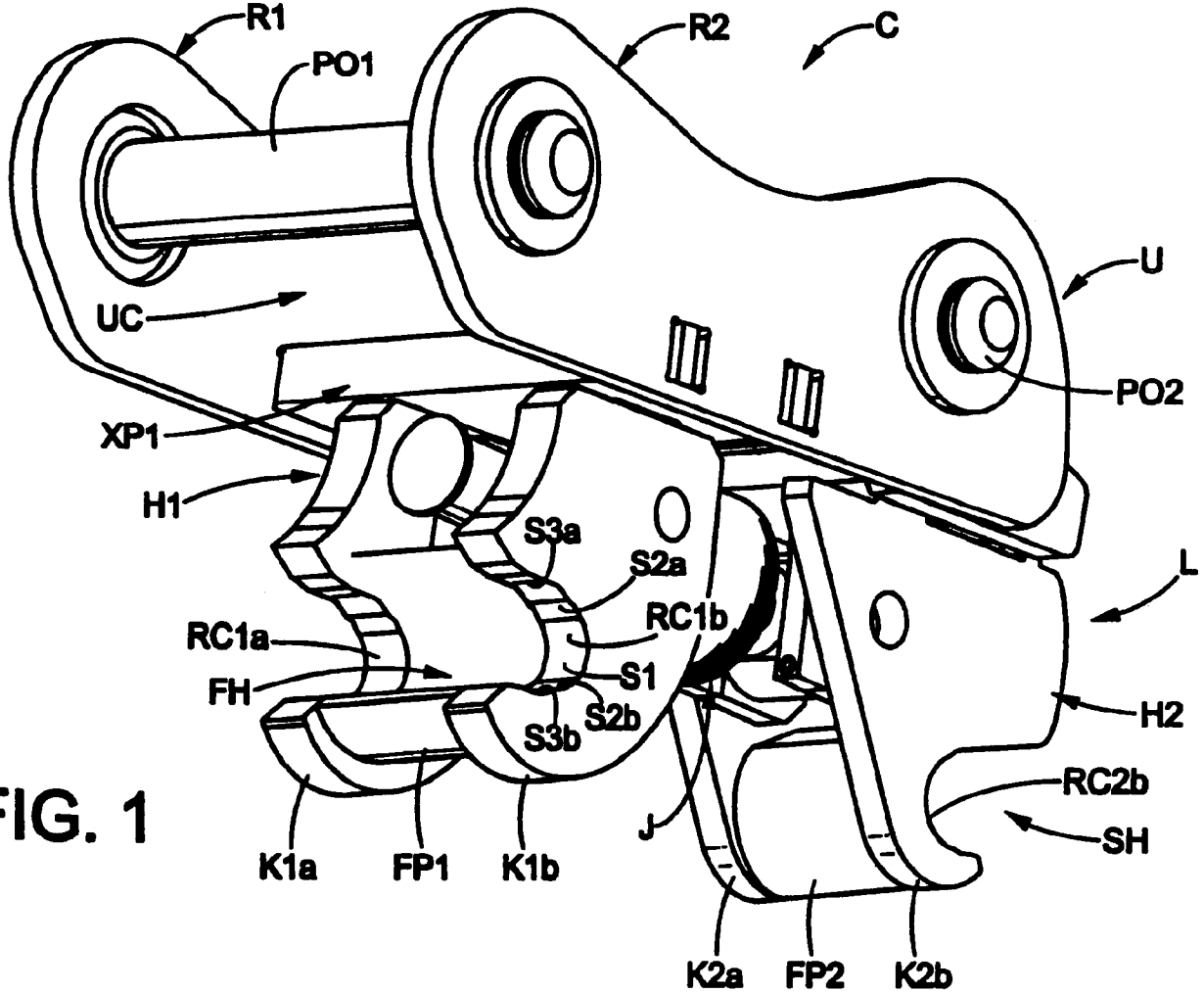
FIG. 1 is a first isometric view of a coupler formed in accordance with the present invention.
Figure 2:
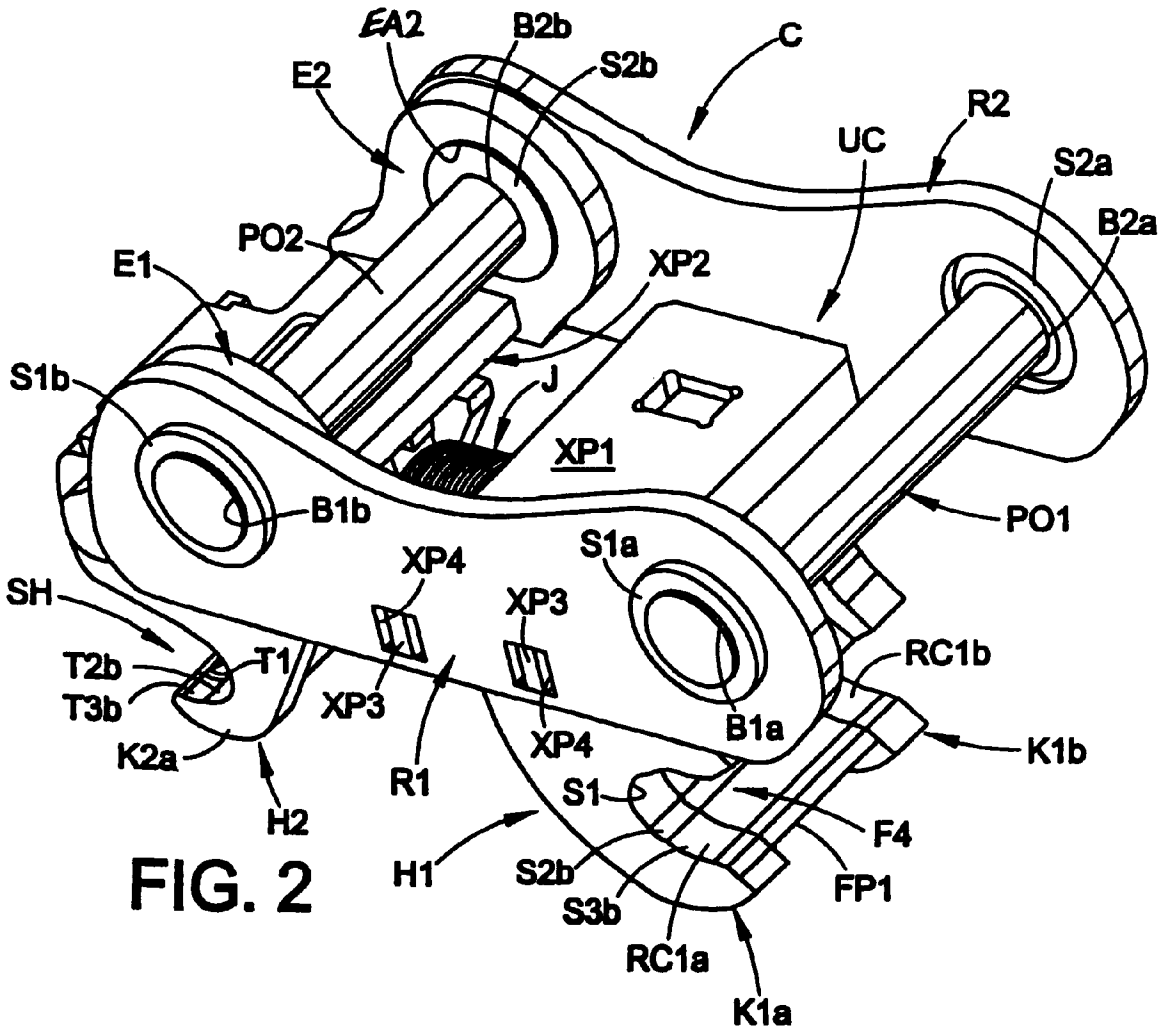
FIG. 2 is a second isometric view of the coupler illustrated in FIG. 1.
Figure 3:
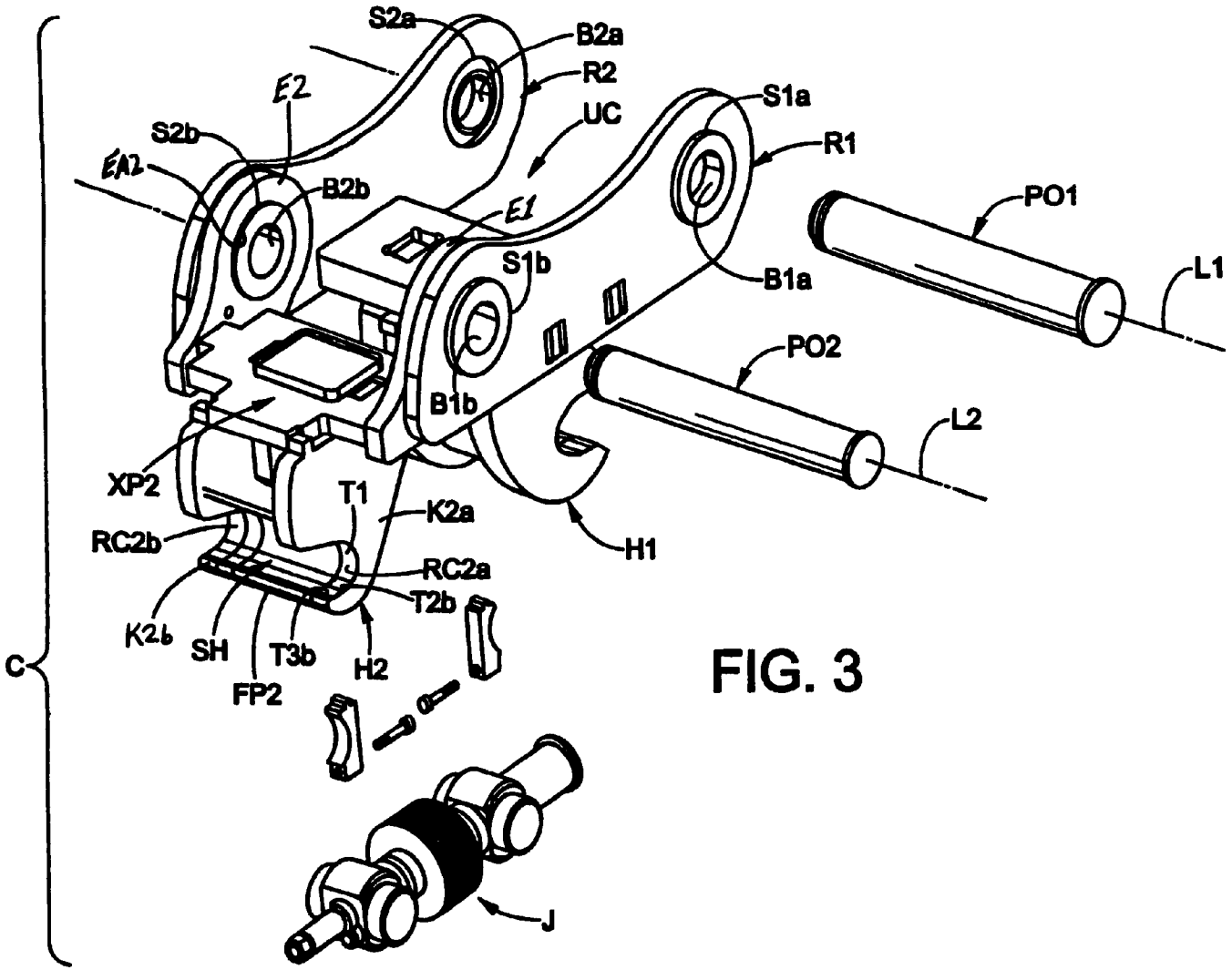
FIG. 3 is an exploded isometric view of the coupler shown in FIGS. 1 & 2.
Figure 4:
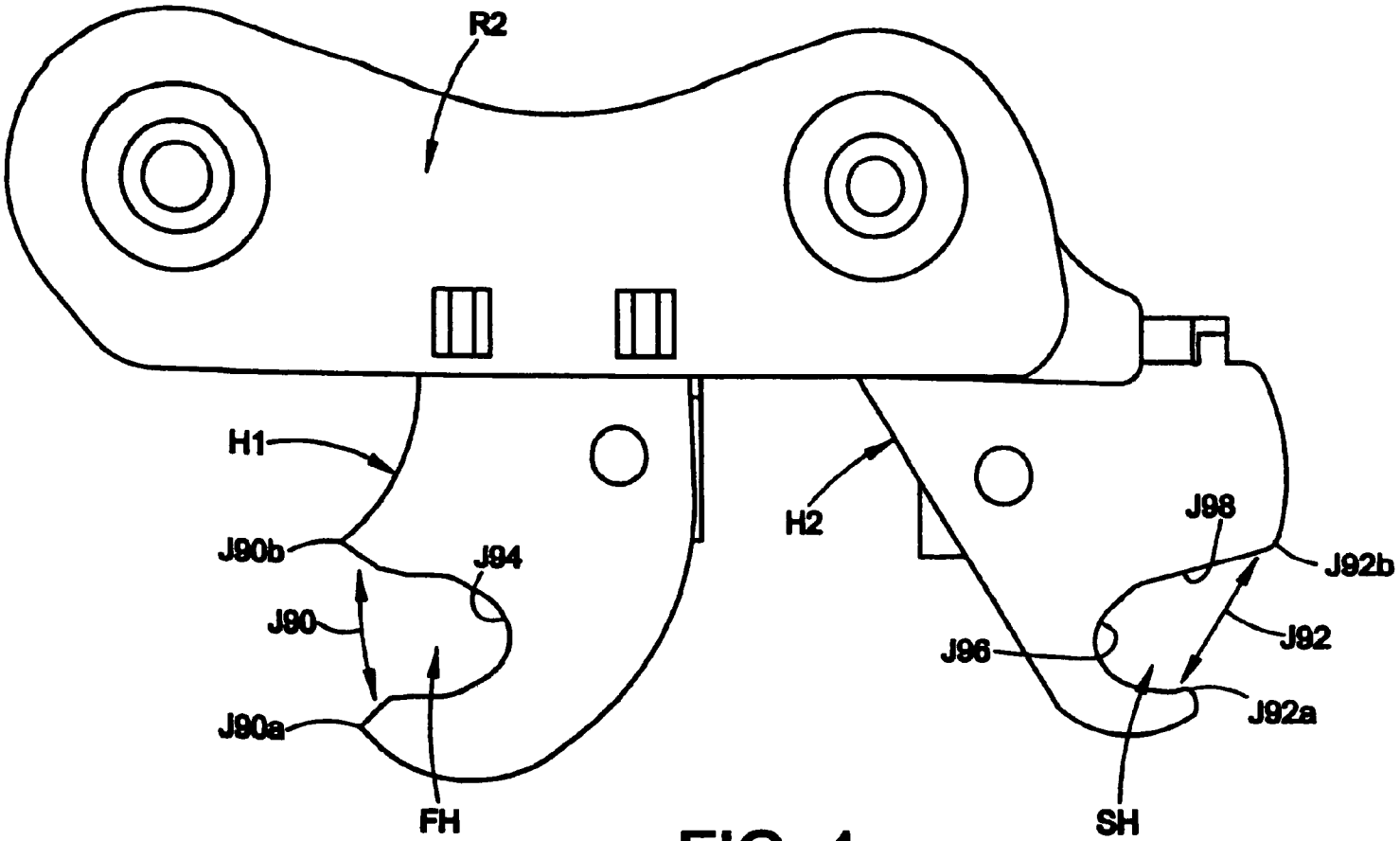
FIG. 4 is a side view of the coupler shown in FIGS. 1 & 2 with the screw jack assembly removed.
Figure 5:
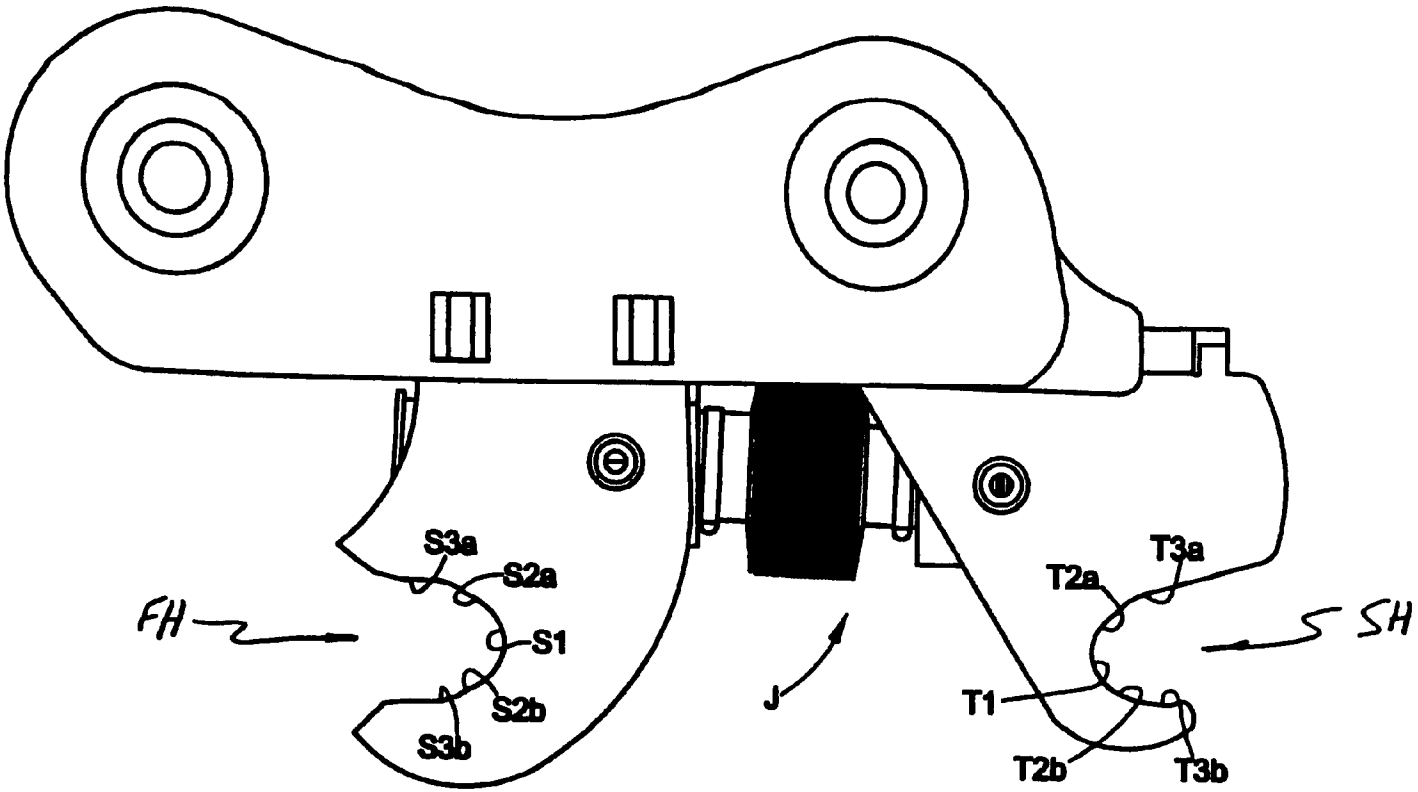
FIG. 5 is a fully assembled side view of the coupler shown in FIGS. 1 & 2.

Referring initially to FIGS. 1-3, a coupler C formed in accordance with the present invention comprises two main sections: (i) an upper section U configured or adapted for pivotable pin-on connection to an arm and control link of an associated excavator, wheel-loader backhoe or any other associated machine having an arm and control link to which the coupler C is operatively connected; and, (ii) a lower section L configured or adapted for releasable operative connection to first and second spaced-apart, parallel pins (see pins P1,P2 in FIGS. 12A-12C) that are connected to an associated bucket, shear, grapple, blade or any other associated attachment. The term "parallel" as used herein is intended to mean exactly parallel and slight variations therefrom as caused by tolerances, minor deformation during welding or use, etc.

The upper section U comprises first and second parallel spaced-apart ribs R1,R2 that define an open channel UC therebetween. The first rib R1 comprises first and second spaced-apart bosses S1*a*,S1*b* that define respective first and second bores B1*a*,B1*b*. Likewise, the second rib R2 comprises first and second spaced-apart bosses S2*a*,S2*b* that define respective first and second bores B2*a*,B2*b*. The bores B1*a*,B2*a* and bores B1*b*,B2*b* are aligned with each other and preferably cylindrically defined about respective parallel axes L1,L2. The aligned bores B1*a*,B2*a* are dimensioned for close, sliding receipt of a first associated pin-on pin PO1. The aligned bores B2*a*,B2*b* are dimensioned for close, sliding receipt of a second associated pin-on pin PO2. In the illustrated embodiment, the first associated pin-on pin PO1 is used to effect a pivotable pin-on connection between the coupler C and an arm of the associated excavator, backhoe or other machine, while the second associated pin-on pin PO2 is used to effect a pivotable pin-on connection between the coupler C and the control link of the associated excavator, backhoe or other machine. The upper section U, including the ribs R1,R2 and bosses S1*a*,S1*b*,S2*a*,S2*b* (and pins PO1,PO2), is defined from any suitable material(s) known in the art such as various metals and alloys thereof such as steel alloys or the like. The spacing between the ribs R1,R2 and position and size of the bosses S1*a*,S1*b*,S2*a*,S2*b* can vary as required to allow for suitable pin-on connections with the associated machine.

The lower section L of the coupler C comprises first and second hook assemblies H1,H2 that are connected to the upper section U and project outwardly therefrom. Unless otherwise noted, the lower section L and the subassemblies thereof are defined from any suitable material(s) known in the art such as various metals and alloys thereof such as steel alloys or the like. The first hook assembly H1 comprises a first cross-plate XP1 to which first and second rear (fixed) hook plates K1*a*,K1*b* are connected in parallel spaced-apart relation. The first and second fixed hook plates K1*a*,K1*b* define respective recesses RC1*a*,RC1*b* that cooperate to define a first hook FH. A first fill plate FP1 extends between and interconnects the hook plates K1*a*,K1*b*. The fill plate is conformed and dimensioned to cooperate with the recesses RC1*a*,RC1*b* to define the first hook FH.

Thus, the first and second fixed hook plates K1*a*,K1*b* and the first fill plate FP1 together define the first hook FH. The first hook FH, as described in further detail below, is conformed and dimensioned to receive a first associated pin P1 (FIGS. 12A-12C) of an associated attachment such as a bucket or blade. The first cross-plate XP1 is preferably fixedly and immovably secured to the ribs R1,R2 and laterally spans the channel UC.

The second hook assembly H2 comprises a second cross-plate XP2 to which first and second front (movable) hook plates K2*a*,K2*b* are connected in parallel spaced-apart relation. The first and second movable hook plates K2*a*,K2*b* define respective recesses RC2*a*,RC2*b* that cooperate to define a second hook SH. A second fill plate FP2 extends between and interconnects the first and second front hook plates K2*a*,K2*b*, and the second fill plate FP2 is conformed and dimensioned to cooperate with the recesses RC2*a*,RC2*b* in the definition of the second hook SH, i.e., the recesses RC2*a*,RC2*b* and the second fill plate FP2 together cooperate to define the second hook SH.

The second hook assembly H2 further comprises first and second ears E1,E2 and the second cross-plate XP2 extends between and is connected at its opposite ends to the respective ears E1,E2. The ear E1 is pivotally connected to the rib R1 and the ear E2 is pivotally connected to the rib R2. More particularly, the ears define apertures EA1,EA2 (see also FIG. 6) that closely rotatably receive the bosses S1*b*,S2*b*, respectively. In some cases it may be desirable to utilize a brass or other bushing located between the ear apertures EA1,EA2 and respective bosses S1*b*,S2*b* to minimize wear and to provide a replaceable wear element. Also, in another alternative embodiment, the bosses S1*b*,S2*b* can, themselves, be provided as or defined by removable and replaceable bushings made of brass or the like, e.g., flanged bushings having enlarged flanges abutted with the ribs R1,R2 and cylindrical bodies extending through the ribs R1,R2 and ear apertures EA1,EA2 and pivotally supporting the ears E1,E2, respectively.

Thus, the first and second front (movable) hook plates K2*a*,K2*b* and the second fill plate FP2 cooperate to define the second hook SH. The second hook SH, as described further below, is conformed and dimensioned to receive a second associated pin P2 of a bucket, blade or other associated attachment (see FIGS. 12A-12C).

The first hook FH and the second hook SH open outwardly away from each other in generally opposite directions. Because the ears E1,E2 of the second hook assembly SH are pivotally connected to the ribs R1,R2, the second hook assembly H2, including the second hook SH, is movable toward and away from the first hook FH as shown by the arrows A1 in FIGS. 12A-12C and as described further detail below.

The coupler C further comprises mechanical, hydraulic, electro-mechanical and/or other type actuator or means for selective moving the second hook assembly H2 relative to the first hook assembly H1 and for selectively fixedly securing the second hook assembly H2 in a desired select operative position relative to the first hook assembly H1. In the illustrated embodiment of FIGS. 1-3, the coupler C comprises a manually driven (or optionally an electro-mechanically or hydraulically driven) screw jack assembly J connected between the second hook assembly H2 and the first hook assembly H1 (or some other fixed part of the coupler C) so that the screw jack assembly J controls the movement and position of the second hook assembly H2 and the second hook SH relative to the first hook assembly H1 and first hook FH. In another embodiment, the screw jack assembly J is replaced by a conventional hydraulic cylinder that extends and retracts axially in response to hydraulic pressure applied in first and second orientations, respectively.

Figure 10A:
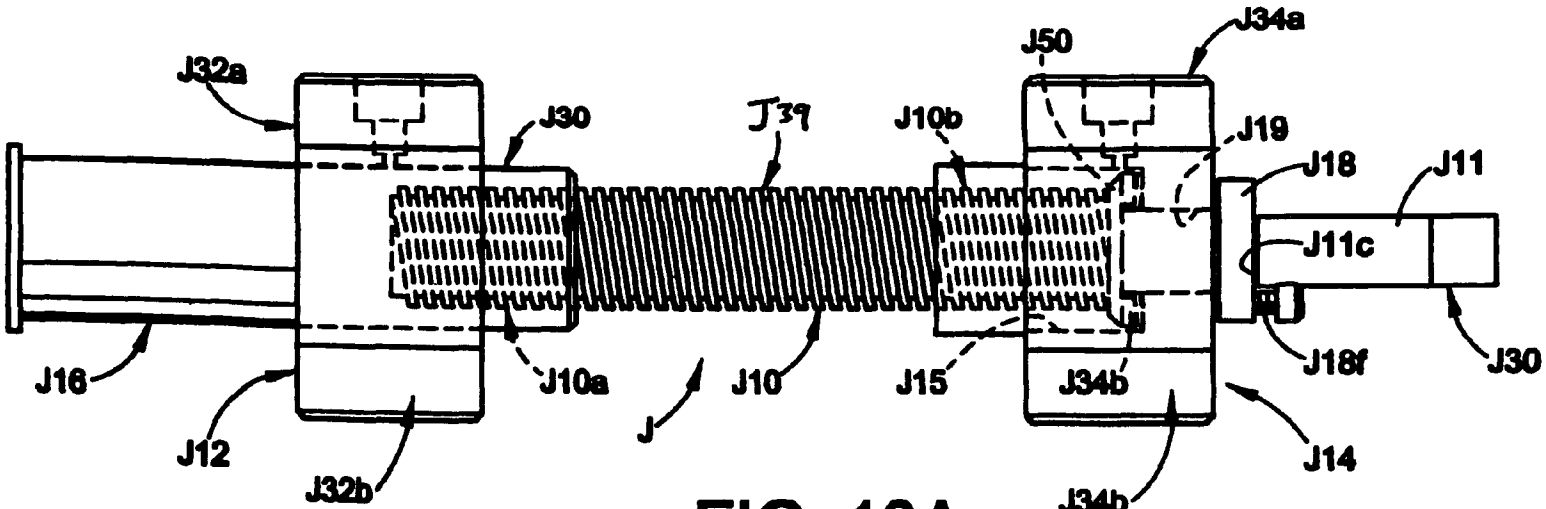
FIGS. 10A & 10B are respective top plan and side views of the screw jack subassembly of the coupler shown in FIGS. 1 & 2.
Figure 10B:
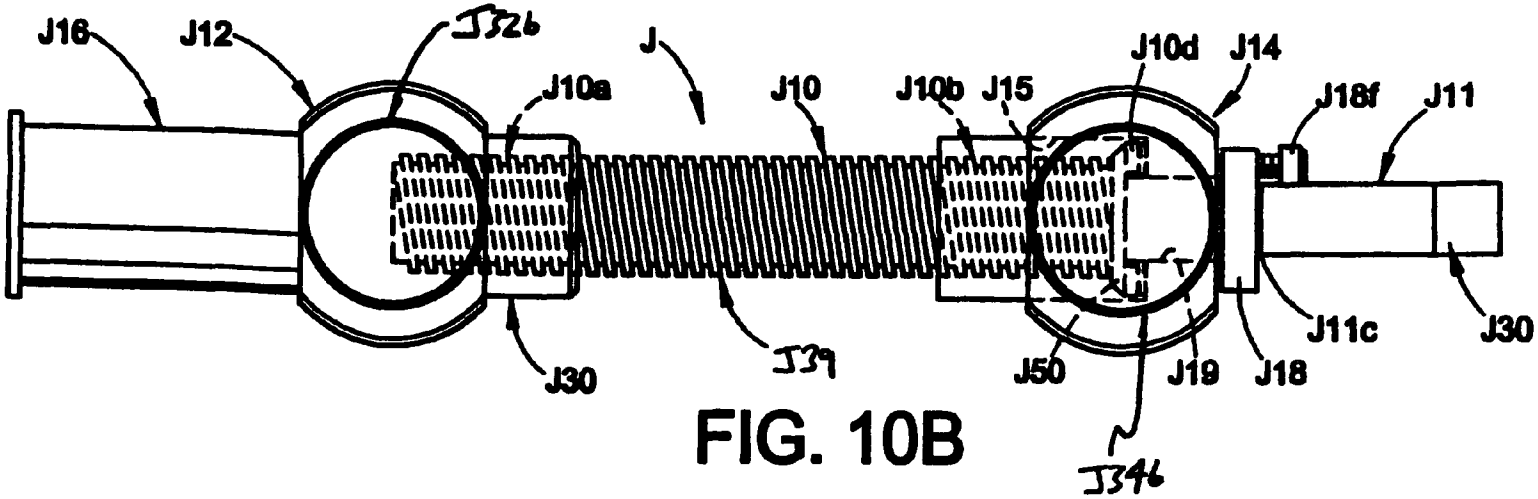
Figure 10D:
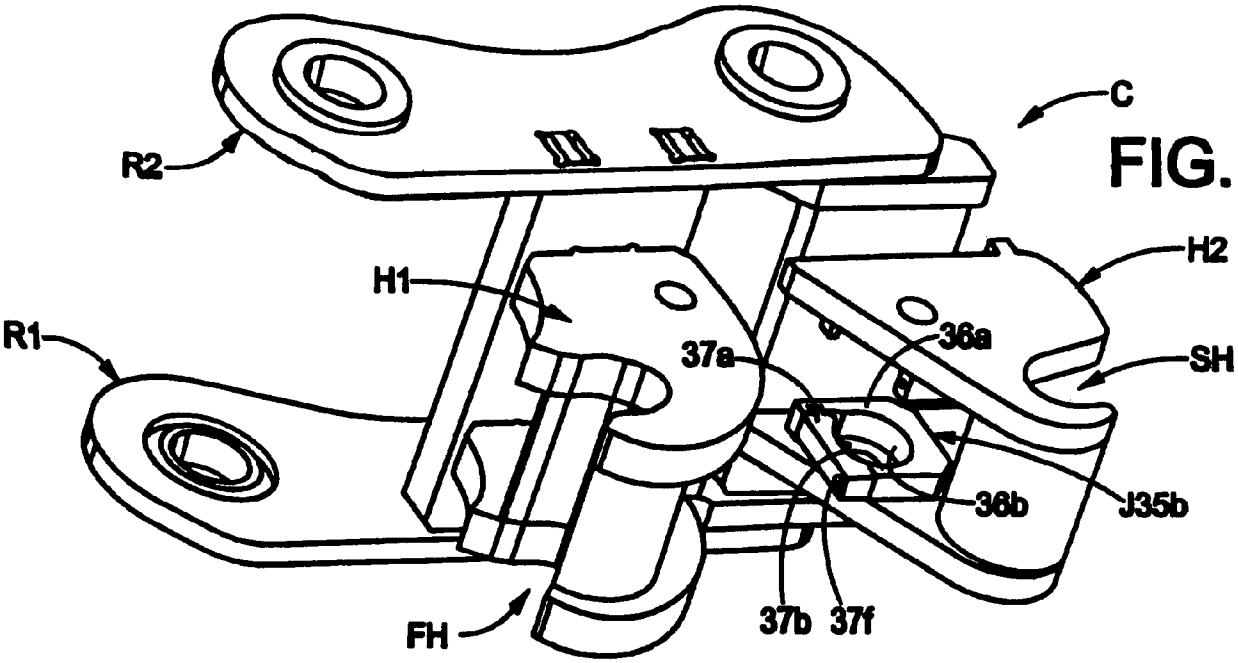
FIG. 10D is a view of the coupler shown in FIGS. 1 & 2 that clearly illustrates a preferred structure for pivotally connecting the screw jack assembly to the first and second hook assemblies.
Figure 10C:
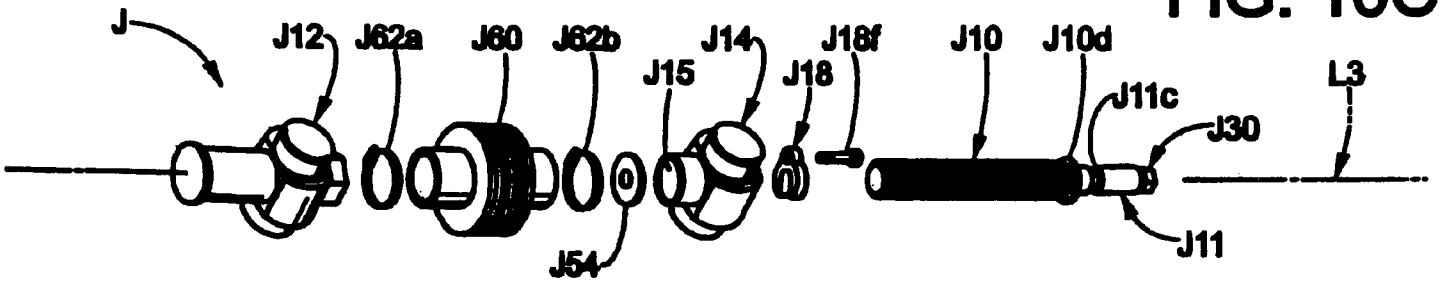
FIG. 10C is an exploded isometric view of the screw jack assembly shown in FIGS. 10A & 10B.

With reference now to FIGS. 10A-10C, the screw jack assembly J comprises a screw member 310 and first and second housing assemblies J12,J14. The first housing assembly J12 is secured to the first hook assembly H1 and the second housing assembly J14 is secured to the second hook assembly H2. The screw member J10 is threaded along at least a portion of its length and extends along a longitudinal axis L3. It is to be noted that in FIGS. 10A, 10B, 12A-12C and 13, certain internal and/or hidden components are illustrated in solid lines rather than broken lines to facilitate understanding of the invention.

The first housing assembly J12 includes an internally threaded nut member or like structure J30 that is threadably engaged with the first end J10*a* of the screw member J10. Thus, the screw member J10 is advanced and retracted relative to the first housing assembly J12 upon rotation of the screw member J10 in first and second directions about the axis L3, respectively. The first housing J12 comprises an enclosed hollow tail or extension 316 that receives and accommodates the portion of the screw member J10 that protrudes through the nut J30 when the screw member is threadably advanced through the nut structure J30. The hollow extension J16 helps to prevent contamination of and damage to the portion of the screw member J10 received therein.

The second end J10*b* of the screw member 310 is connected to the second housing assembly J14 in a manner that allows rotational movement of the screw member J10 about the axis L3 without any threaded engagement between the screw member J10 and the second housing assembly J14. As such, rotation of the screw member 10 does not result in threaded advancement or retraction of the second housing assembly 314 relative to the screw member J20. More particularly, the second housing assembly J14 includes or defines a recess J15 that receives a portion of the second end J10*b* of the screw member J10, and a shank J11 of the screw member projects through an aperture J19 defined in the second housing assembly J14. A removable C-collar J18 or the like is used to secure the screw member J10 to the second housing assembly J14 to prevent axial separation between these two members J10,J14 while allowing the screw member J10 to rotate about its longitudinal axis L3. The C-collar J18 (see also FIG. 8) is positioned axially between the second housing assembly J14 and a shoulder J11*c* of shank J11 and secured to the second housing assembly using a screw or other fastener J18F. The C-collar J18 captures the second housing assembly J14 between itself (the C-collar J18) and an enlarged radial flange J10*d* of the screw member J10 so that the screw member J10 cannot be separated axially from the second housing member J14 (limited axial movement or "play" of the screw member J10 relative to the second housing assembly J14 is allowed and desirable for reasons noted below).

As noted, the first and second housing assemblies J12,J14 are secured respectively to the first and second hook assemblies H1,H2 in the illustrated embodiment. During use of the screw jack assembly to pivot the second hook assembly H2 relative to the first hook assembly H1, limited angular movement between the screw member J10 and the hook assemblies H1,H2 must be accommodated. In the illustrated embodiment, the first housing assembly J12 is pivotally connected to the first hook assembly H1 and the second housing assembly J14 is pivotally connected to the second hook assembly H2.

Figure 7:
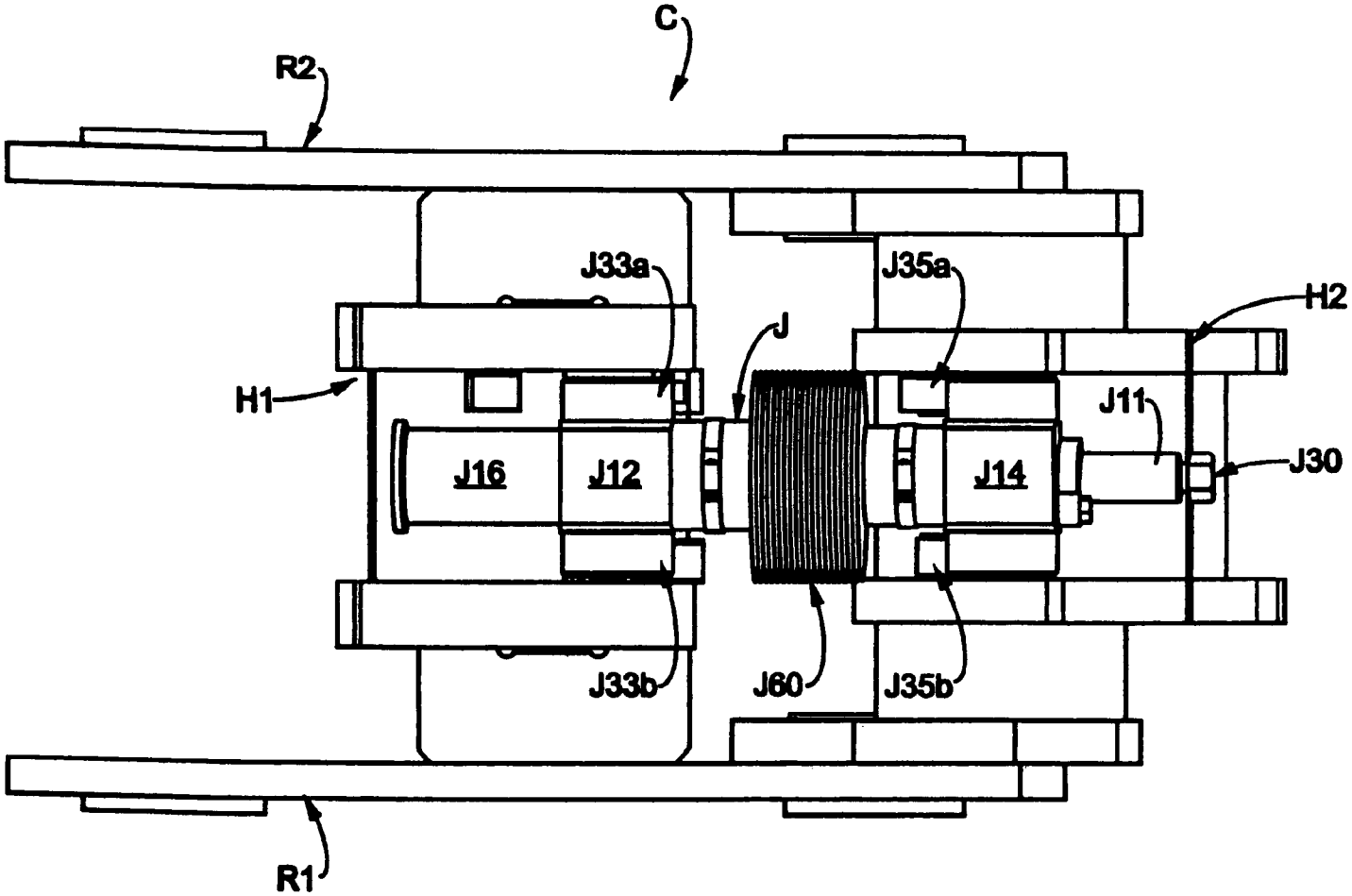

More particularly, as illustrated herein, the first housing assembly J12 comprises first and second cylindrical hubs J32*a*,J32*b* projecting outwardly from opposite lateral sides thereof. These hubs J32*a*,J32*b* are pivotally or rotatably engaged with respective cylindrical hub-receiving portions J33*a*,J33*b* of the first hook assembly H1 as shown in FIG. 7. Likewise, the second housing assembly J14 comprises first and second cylindrical hubs J34*a*,J34*b* projecting outwardly from opposite lateral sides thereof. These hubs J34*a*,J34*b* are pivotally or rotatably engaged with respective cylindrical hub-receiving portions J35*a*,J35*b* of the second hook assembly H2 as shown in FIG. 7. It is preferred that each the hub-receiving portions J33*a*,J33*b*,J35*a*,J35*b* comprise a recess and a keeper that is selectively secured adjacent the recess by a fastener to capture the hub J32*a*,J32*b*,J34*a*,J34*b* adjacent the recess. FIG. 10D shows a suitable arrangement for the hub-receiving portions J33*a*,J33*b*,J35*a*,J35*b* (only the portion J35*b* is visible in FIG. 10D but the others J33*a*,J33*b*, J35*a* have the same described structure). The hub-receiving portion J35*b* comprises a first or base member 36*a* that is connected to or an integral part of the second hook assembly H2 and defines a partially-cylindrical recess 36*b*. A keeper 37*a* defines a partially-cylindrical recess 37*b* and is selectively and releasably connected to the first member 36*a* via fastener 37*f*. It can be seen that the recesses 36*b*,37*b* of the base 36*a* and keeper 37*a* cooperate to define a cylindrical hub-receiving space for the cylindrical hub J34*a*.

Figure 8:
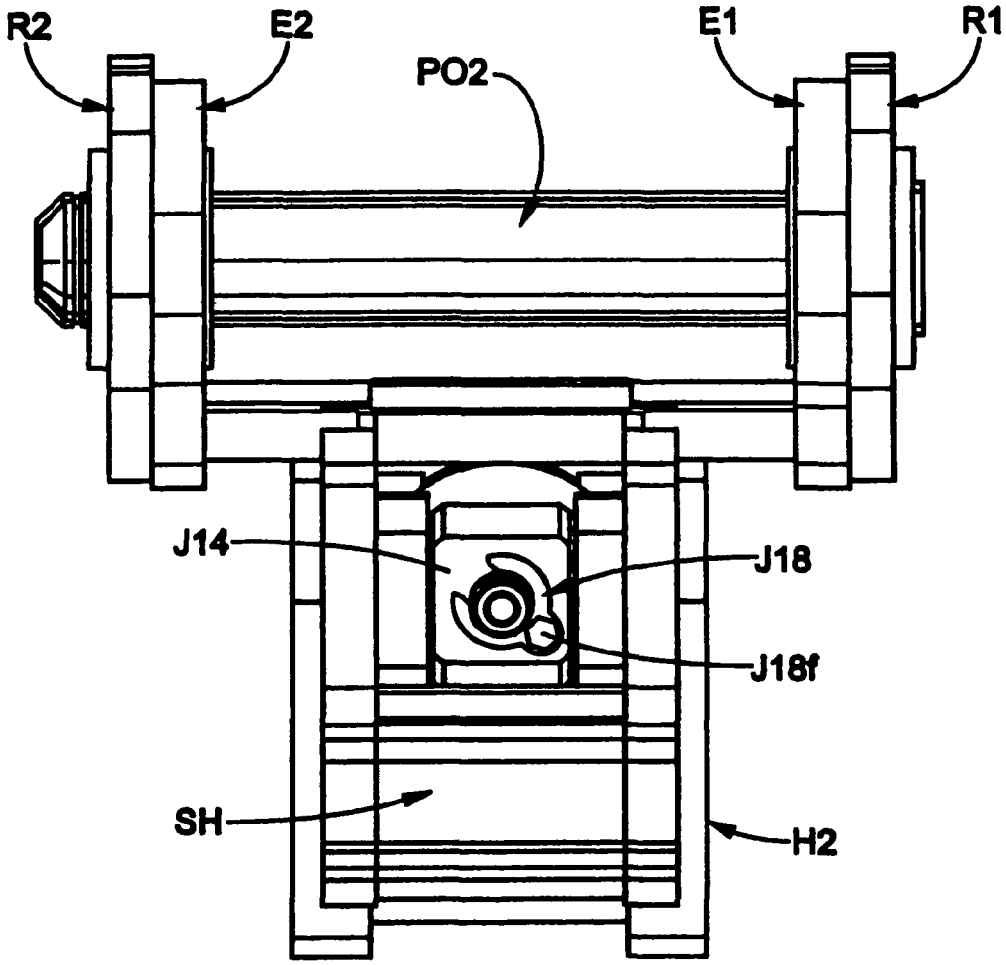
FIGS. 8 & 9 are first and second end views, respectively, of the coupler shown in FIGS. 1 & 2.
Figure 9:
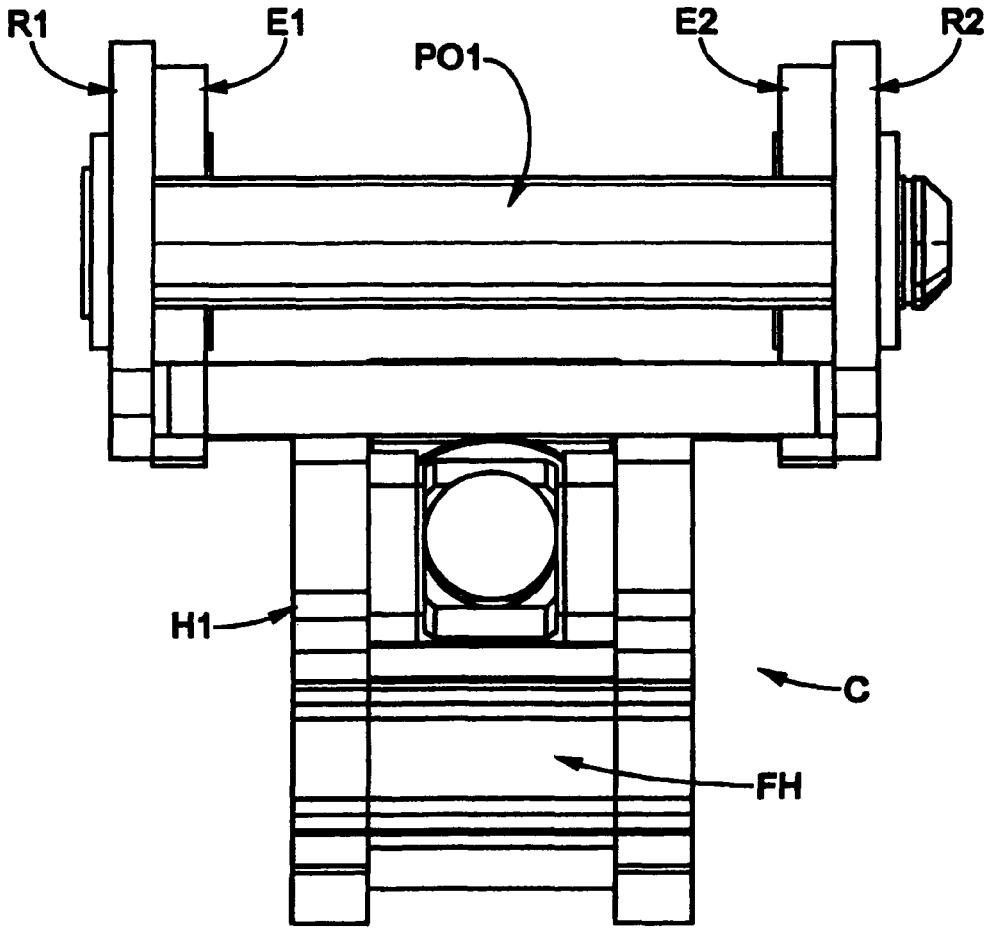

The shank J11 of the screw member J10 comprises a head portion 330 defined as a polygon or other suitable shape for being drivingly engaged by an associated tool (see also FIG. 8). Thus, the screw member J10 is rotatable clockwise and counter-clockwise about its longitudinal axis L3 via torque applied to the head J30 from an associated tool. It is preferred that the screw jack assembly J be configured as shown herein, with the driving head J30 located near the second hook assembly H2 rather than the first hook assembly H1, in that the driving head J30 is easily visible during coupling and decoupling of attachments, although it is not intended that the invention be limited only to the illustrated arrangement.

As noted, a wrench or other tool is used on the head portion J30 to rotate the screw member J10 as desired to control the position of the front or second hook assembly H2 on the arc A1 (FIGS. 12A-12C) which, in turn, controls the distance between the first hook FH and second hook SH. With reference to FIGS. 12A-12C, the coupler C is used to operatively couple with a bucket or other associated attachment by positioning the first and second hooks FH,SH between first and second pins P1,P2 of the associated attachment, with the first pin P1 fully or partially received in the first hook FH as shown in FIG. 12A. Thereafter, the screw J10 is rotated by a tool acting on the head portion J30 to pivot the second hook assembly H2 on the arc A1 away from the first hook portion H1 so that the second pin P2 of the bucket or other associated attachment moves partially (FIG. 12B) and then fully (FIG. 12C) into the second hook SH. The screw member 310 is rotated still further until both the first pin P1 and second pin P2 are fully and firmly seated in the respective first and second hooks FH,SH so that the associated bucket or other attachment is operatively secured to the coupler C.

The threads 339 on the screw member J10 are designed to inhibit rotation of the screw member J10 under axial loading thereof. For example, in one preferred embodiment, it is preferred that ACME threads be used to achieve this result. Thus, when the coupler C is in use and loads are exerted on the second hook assembly H2 in a direction toward the first hook assembly H2, the screw member J10 will resist rotation owing to the ACME threads. In one example the screw member J10 is a 1.25 inch diameter screw with ACME threads that are configured as five threads/inch single lead or as otherwise deemed appropriate for the size and rating of the coupler C.

Figure 11:
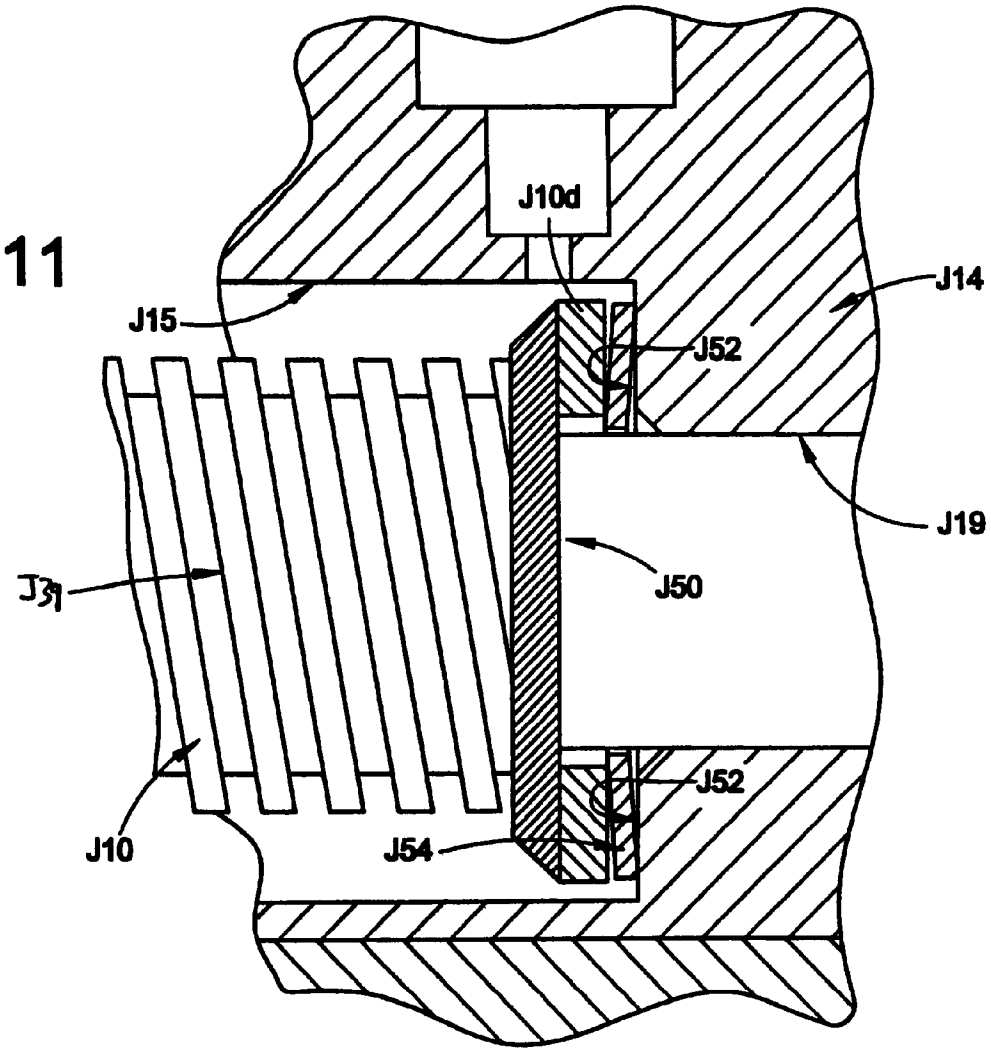
FIG. 11 is a greatly enlarged partial illustration of the screw jack subassembly shown in FIGS. 10A-10C and showing the disc lock mechanism thereof.

As noted above, limited axial movement or "play" is present between the second housing assembly J14 and the screw member J10. This is desirable for operation of a disc lock mechanism 350 that forms a part of the present coupler C. With reference to FIGS. 10A,10B and 11, the second housing assembly J14 defines an internal bearing wall J52 (see enlarged FIG. 11) that partially defines the recess J15. As noted above, the screw member J10 includes an enlarged radial flange J10*d* located adjacent the bearing wall J52. A Belleville spring/washer or disc spring member J54 is arranged coaxial with the screw member J10 axially between the flange J10*d* and the bearing wall J52, preferably with the concave portion thereof oriented toward the bearing wall J52. The disc spring J54 preferably requires a high force of about 700-800 pounds to be completely compressed or flattened.

In use, rotation of the screw member J10 results in spreading of the second hook assembly H2 away from the first hook assembly H1 as described above, and the disc lock mechanism has no material effect on this initial operation. However, as the first and second hooks FH,SH engage their respective attachment pins P1,P2 and resist further spreading relative to each other, the flange J10*d* and bearing wall J52 are urged forcibly toward each other against the biasing force of the disc spring J54. Upon sufficient rotation of the screw member J10, the disc spring will become partially and, ultimately, fully compressed when the first and second attachment pins P1,P2 are fully and operatively seated in the respective hooks FH,SH. When compressed or partially compressed, the disc spring J54 exerts constant axial forces on the flange J10*d* and bearing wall J52 in opposite axial directions, i.e., the disc spring J54 attempts to urge the flange J10*d* and bearing wall J54 axially away from each other. This axial loading results in high friction at the interface of the flange J10*d* with the disc J54 and also results in high friction at the interface of the disc J54 with the bearing wall J52. These high friction conditions prevent or severely inhibit unintended or free rotation of the screw member J10 during use and, thus, "lock" the screw member J10 in position when the first and second pins P1,P2 are fully and operatively seated in the first and second hooks FH,SH. Those of ordinary skill in the art will recognize that the disc lock mechanism J50 is "touch sensitive" in that it has no meaningful effect on rotation of the screw member J10 until both the first and second hooks FH,SH are at least partially engaged with the respective pins P1,P2. Furthermore, the use of a Belleville spring J54 as described herein is preferred because the spring J54 requires only a very small axial compression or displacement to be fully compressed.

The screw jack assembly J preferably comprises a bellows J60, made from rubber, plastic or the like (see e.g., FIGS. 1-7 and 10C). The bellows J60 is secured at its opposite ends adjacent the first and second housing assemblies J12,J14, respectively, by clamps J62*a*,J62*b* or the like. The bellows J60 encases the screw member J10 between the first and second housing assemblies J12,J14 and lengthens and shortens as required to accommodate different spacing between the housings J12,J14. The bellows J60 prevents or at least inhibits flow of dirt and water to the screw member J10 and the housings J12,J14.

The first hook FH is conformed or defined so that its open mouth J90 (see FIG. 4) is fanned or widely diverging moving outwardly away from an innermost end J94. This shape facilitates insertion of the first attachment pin P1 into the first hook FH. The mouth J90 of the first hook FH is defined between first and second terminal ends J90*a*,J90*b* of the first hook FH, and these first and second terminal ends J90*a*,J90*b* are spaced at least approximately the same distance from the innermost end 394 of the first hook FH. The second hook SH comprises a mouth 392 defined between first and second terminal ends J92*a*,J92*b* of the second hook SH. The second terminal end J92*b* is spaced farther from the innermost end J96 of the second hook SH as compared to the first terminal end J92*a*. Preferably the second terminal end J92*b* is spaced from the innermost surface J96 at least 1.5-2.0 times the distance between the first terminal end J92*a* and the innermost surface J96. The second hook SH thus comprises a smooth guide ramp J98 located opposite the first terminal end J92*a* and that extends outwardly away from the innermost surface J96 toward and into the second terminal end J92*b*. In use during coupling operations, a first attachment pin P1 is received in the first hook FH and the coupler C is then pivoted about the first attachment pin P1 so that the second attachment pin P2 abuts the ramp J98 of the second hook SH. The second hook SH is then pivoted away from the first hook FH as described above so that the second attachment pin P2 slides on the ramp J98 toward the innermost surface J96 and until the second pin P2 is fully received in the second hook SH.

As illustrated, it is preferred that both the first and second hooks FH,SH be defined by multiple arcuate or circular surfaces defined along respective multiple radii. This allows multiple pin diameters for the pins P1,P2 to be accommodated in each hook FH,SH and also increases the contact surface area between each pin P1,P2 and the surfaces defining the hooks FH,SH. As shown, e.g., in FIGS. 1-3 and 5, the first hook FH includes a first surface S1 defined by a first radius centered at a first point, second surfaces S2*a*,S2*b* each defined by a second radius centered at a second point and third surfaces S3*a*,S3*b* each defined by a third radius centered at a third point. In one example, the first radius equals 1.50 inches, the second radius equals 1.75 inches and the third radius equals 2.16 inches. Similarly, the second hook SH includes a first surface T1 defined by a first radius centered at a first point, second surfaces T2*a*,T2*b* defined by a second radius centered at a second point and third surfaces T3*a*,T3*b* defined by a third radius centered at a third point. In one example, the radius defining the first surface T1 is equal to 1.5 inches, the radius defining the second surfaces T2*a*,T2*b* is equal to 1.75 inches and the radius defining the third surfaces T3*a*,T3*b* is equal to 2.0 inches.

Figure 13:
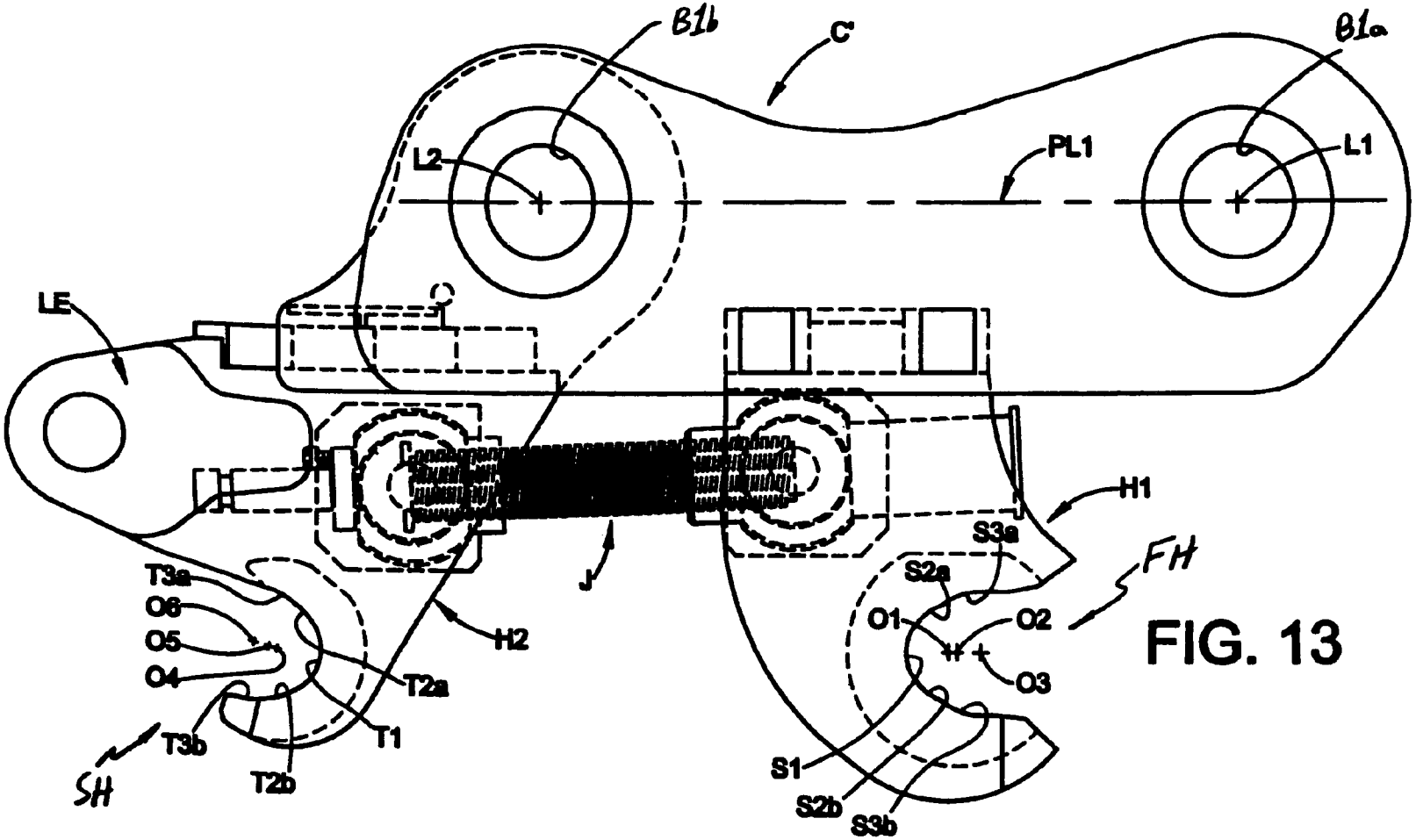
FIG. 13 illustrates an alternative coupler formed in accordance with the present invention.

FIG. 13 illustrates an alternative coupler C' formed in accordance with the present invention. Except as shown and/or described, the coupler C' is identical to the coupler C and FIG. 13 uses reference characters that are identical to those used in FIGS. 1-12C to indicate like parts relative to the coupler C. Unlike the coupler C, however, the coupler C' includes at least one lift eye LE that projects outwardly from the second hook assembly H2.

FIG. 13 also illustrates a preferred construction of the coupler C,C' wherein the arcuate surfaces S1; S2*a*,S2*b*; S3*a*, S3*b* of first hook FH are defined by radii centered respectively at O1;O2;O3, and wherein the arcuate surfaces T1; T2*a*,T2*b*; T3*a*,T3*b* of second hook SH are defined by radii centered respectively at O4;O5;O6. A line interconnecting the origins O1-O3 is parallel or nearly parallel (within 5 degrees of parallel) to a plane PL1 including the axes L1,L2 of pin-on bores B1*a*,B1*b*. On the other hand, when the second hook SH is fully pivoted away from the first hook FH as shown in FIG. 13 to a spread position where an attachment pin P2 (FIG. 12C) is fully seated therein, a line interconnecting the origins O4-O6 is inclined relative to the plane PL1 so that it intersects the plane PL1 moving away from the first hook FH at an angle of 10 to 20 degrees, preferably about 15 degrees. This arrangement ensures that a second attachment pin P2 will be effectively captured in the second hook SH for all operative positions of the second hook SH, i.e., the line interconnecting the origins O4-O6 will always lie between a position parallel to the plane PL1 and the position shown in FIG. 13 when the first and second attachment pins P1,P2 are fully and operatively seated in the hooks FH,SH for all spacings between the first and second attachment pins P1,P2. This ensures that the second attachment pin P2 will always be effectively captured in the second hook SH even when the second attachment pin P2 is located relatively close to the first attachment pin P1.

Figure 6:
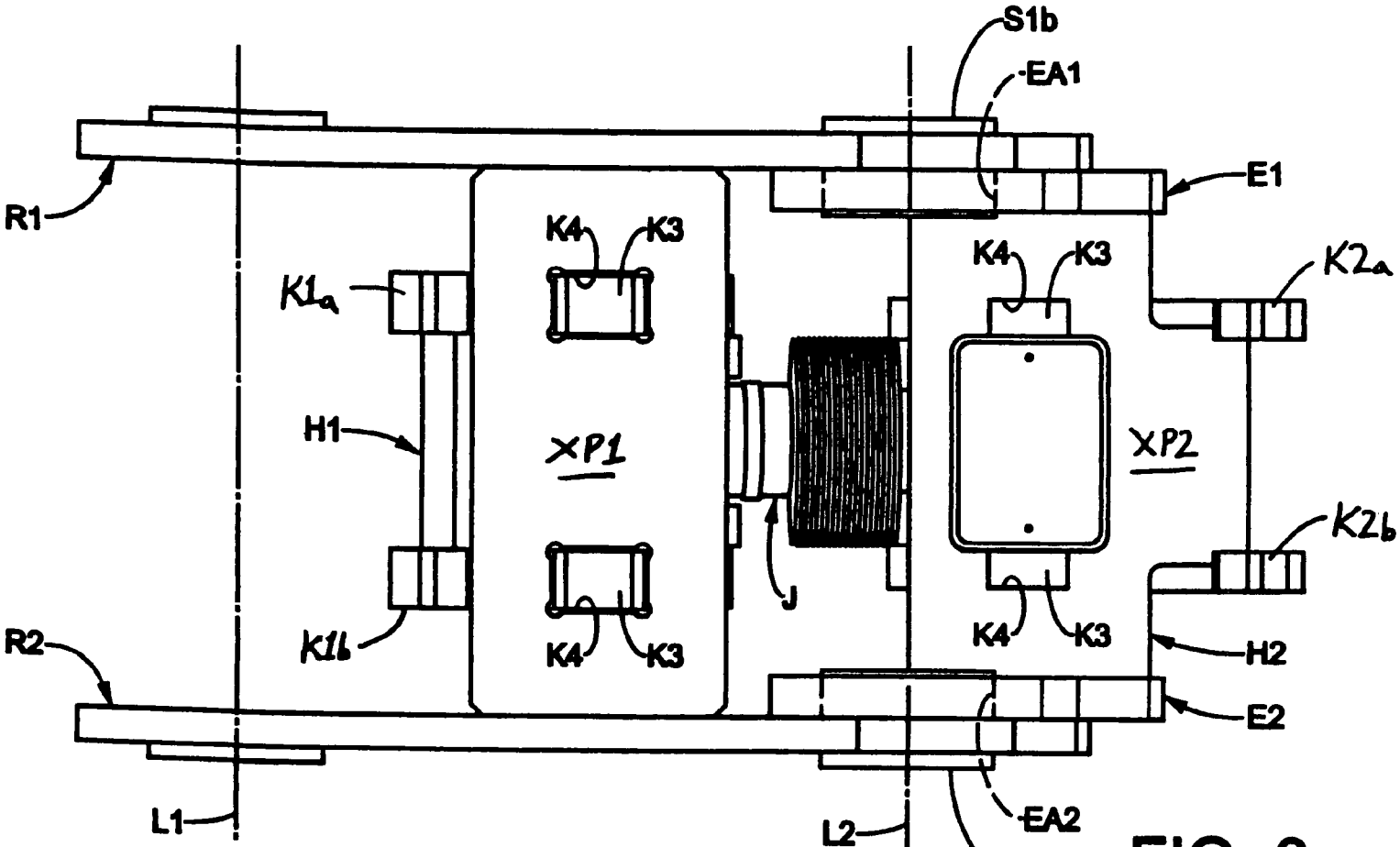
FIGS. 6 & 7 are top and bottom plan views, respectively, of the coupler shown in FIGS. 1 & 2.

It is preferred that the coupler C,C' be constructed so that, whenever possible, a connection of two plates or other components is carried out by insertion of one or more tabs projecting from the first component into corresponding mating slot(s) defined in the second component and then welding the first and second components together. As shown in FIG. 6, for example, the plates K1*a*,K1*b*,K2*a*,K2*b* include respective tabs K3 that are received in respective slots K4 defined in the cross-plates XP1,XP2 and that are then welded in such position. Also, the cross-plates XP1,XP2 include tabs XP3 that are received in slots XP4 defined by the ribs R1,R1 (see, e.g., FIG. 2) and that are then welded in such position. This construction technique facilitates construction without a "jig" and also can be used to ensure that parts are not improperly positioned. The slots K4,XP4 can be filled-in with the weld material for improved aesthetics if desired.

Instead of screw jack assembly J, the coupler C,C' can include an alternative screw jack assembly J' that is identical to the screw jack assembly J, except as otherwise shown and/or described here. Accordingly, like components of the screw jack assembly J' relative to the screw jack assembly J are identified with like reference characters that include a primed (') suffix. New components are identified with new reference characters.

The alternative screw jack assembly J' comprises a screw member J10' (FIG. 14C) and first and second housing assemblies J12',J14'. The first housing assembly J12' is secured to the first hook assembly H1 and the second housing assembly J14' is secured to the second hook assembly H2. The screw member J10' is threaded along at least a portion of its length and extends along a longitudinal axis L3'.

The first housing assembly J12' comprises a first tube member TU1 and the second housing member comprises a second tube member TU2. The first tube member TU1 is telescopically received inside the second tube member TU2 so that the first and second tube members TU1,TU2 cooperate to enclose at least a portion of the screw member J10' that extends between the housing assemblies J12',J14'. A seal JS is connected to the second tube member TU2 and sealingly engages the first and second tube members TU1,TU2 to inhibit entry of water, dirt and other contaminants between these members into the space enclosing at least a portion of the screw J10'.

An internally threaded nut member or like structure J30' is connected to the first tube member TU1 or other portion of the first housing assembly J12' and is threadably engaged with the screw member J10'. Thus, upon rotation of the screw member J10' about the axis L3' the nut member J30' and the first housing assembly J12' are advanced or retracted on the screw member J10' relative to the second housing assembly J14' depending upon the direction in which the screw member J10' is rotated. The tube members TU1,TU2 slidably extend and retract relative to each other but always cooperate to enclose and protect the portion of the screw member J10' extending between the first and second housing assemblies J12',J14'. Advancement of the nut member J30' on the screw member J10' in a first direction is limited by a first flange stop member ST1 connected to end J10*a*' of screw member J10', and advancement of the nut member J30' in the opposite direction is limited by a second flange stop member ST2 or by abutment of the tube members TU1,TU2.

The second end J10*b*' of the screw member J10 is connected to the second housing assembly J14' in a manner that allows rotational movement of the screw member J10' about the axis L3' without any threaded engagement between the screw member J10' and the second housing assembly J14'. The second housing assembly J14' includes or defines a recess J15' that receives a portion of the second end J10*b*' of the screw member J10', and a shank J11' of the screw member J10' projects through an aperture J19' defined in the second housing assembly J14'. A clamp J18' or the like is engaged with a circumferential groove of the shank J11' to secure the screw member J10' to the second housing assembly J14' to prevent axial separation between these two members J10',J14' while allowing the screw member J10' to rotate about its longitudinal axis L3'.

Figure 14A:
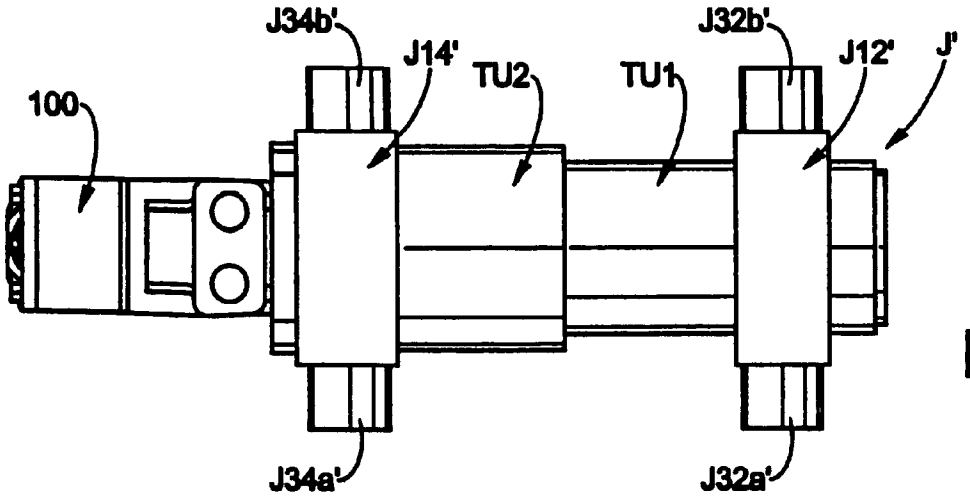
FIGS. 14A and 14B are top plan views of an alternative hydraulic screw jack assembly formed in accordance with the present invention, with the screw jack assembly extended in FIG. 14A and retracted in FIG. 14B.
Figure 14B:
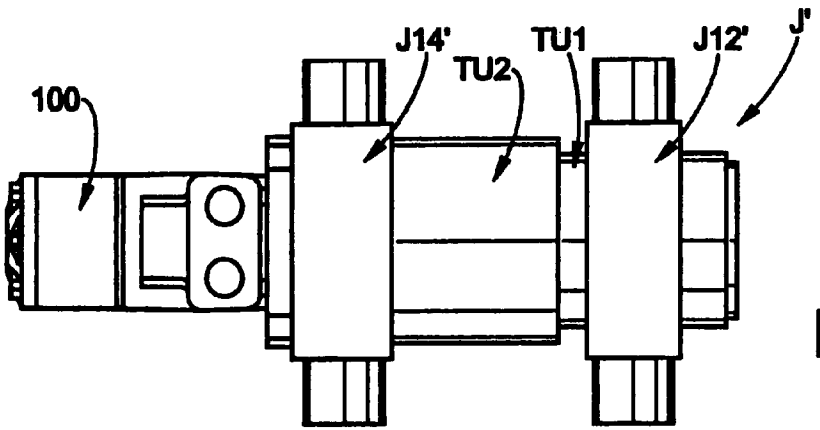
Figure 14C:
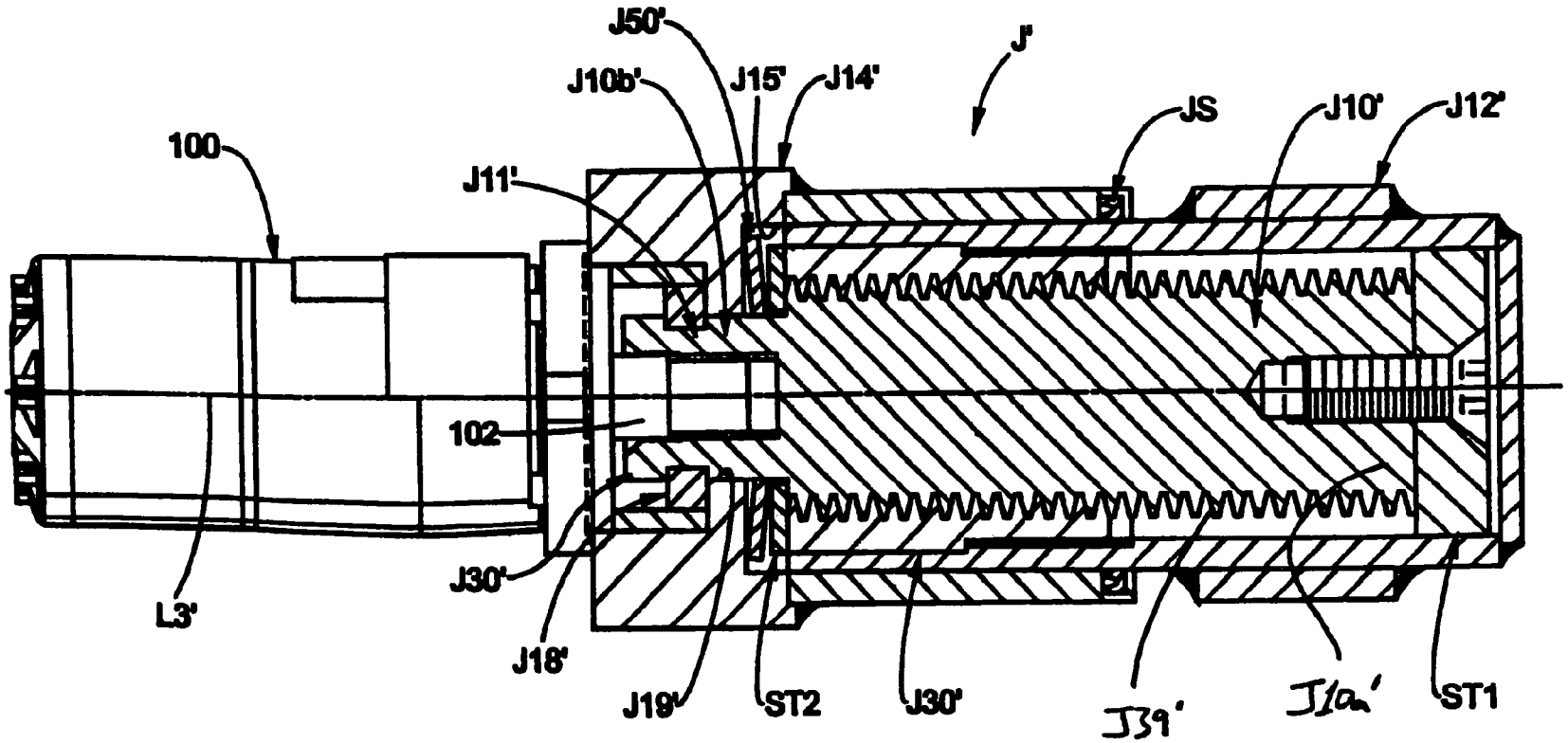
FIG. 14C is a sectional view taken along line C-C of FIG. 14B.

The first housing assembly J12' comprises first and second cylindrical hubs J32*a*',J32*b*' projecting outwardly from opposite lateral sides thereof (FIG. 14A). The second housing assembly J14' comprises first and second cylindrical hubs J34*a*',J34*b*' projecting outwardly from opposite lateral sides thereof (FIG. 14A). The first and second housing assemblies J12',J14' are secured to the first and second hook assemblies H1,H2 in the same manner as described above.

Referring again to FIG. 14C, the shank J11' of the screw member J10' comprises a head portion J30' that is drivingly engaged by an output shaft 102 of an associated rotary hydraulic motor 100. Thus, the screw member J10' is rotatable clockwise and counter-clockwise about its longitudinal axis L3' via torque applied to the head J30' by the output shaft 102 of the motor 100. The motor 100 is bolted or otherwise secured to the second housing assembly J14'. In the preferred embodiment, when the motor 100 is bolted to the second housing assembly J14', the motor 100 abuts and holds the clamp J18' in its operative position where the clamp J18' axially secures the screw member J10'.

During use of the coupler C,C' including the screw jack assembly J', the motor 100 is used to selectively rotate the screw member J10' as desired to pivot the second hook assembly H2 relative to the first hook assembly H1. The motor 100 is also used to prevent undesired rotation of the screw member J10' under axial loading of the screw member 310' during use of the coupler. The screw member J10' also preferably utilizes ACME threads as described above for threadably connecting to the nut member J30'. In one example, the screw member J10' is a three inch diameter screw member having single lead ACME threads arranged at four threads/inch.

The screw jack assembly J' also preferably includes a disc lock mechanism J50' that operates in a corresponding manner as described above in relation to the disc lock J50.

The motor 100 is preferably a hydraulic motor operating at about 1250 pounds per square inch (psi). The motor 100 is pressurized in a first orientation to rotate the output shaft 102 (and screw member J10') in a first direction to spread the second housing assemblies J14' away from the first housing assembly J12'. The motor 100 is pressurized in a second orientation to rotate the output shaft 102 (and screw member J10') in a second direction to draw the second housing assembly J14' toward the first housing assembly 312'. During use of the coupler C,C' with an attachment operatively connected thereto via first and second attachment pins P1,P2 seated in the respective hooks FH,SH, it is preferred that the motor 100 be continuously pressurized in the first orientation to bias or urge the output shaft 102 in the first direction (even though further rotation in the first direction is not possible when the pins P1,P2 are fully seated in the hooks FH,SH) to prevent unintended rotation of the output shaft 102 in the opposite second direction as could lead to decoupling of the attachment from the coupler C,C'.

The hydraulic fluid used to drive the motor 100 can also serve as a lubricant for the screw member J10'. In this arrangement, hydraulic fluid expelled by the motor 100 or otherwise available to drive the motor is communicated into the space enclosed by the telescoped members TU1,TU2 to lubricate the screw member 310'.

The coupler C,C' including the hydraulic motor 100 is also manually operable in the same manner as the screw jack assembly J simply by removal of the hydraulic motor 100 to allow the screw member J10' to be drivingly engaged, either directly by a mating tool or indirectly through a shaft or adapter. In the latter case, the motor 100 is replaced by a shaft having a first end that drivingly mates with the screw member J10' and a second end that includes or defines a driving head adapted for driving engagement by an associated tool.

Figure 15A:
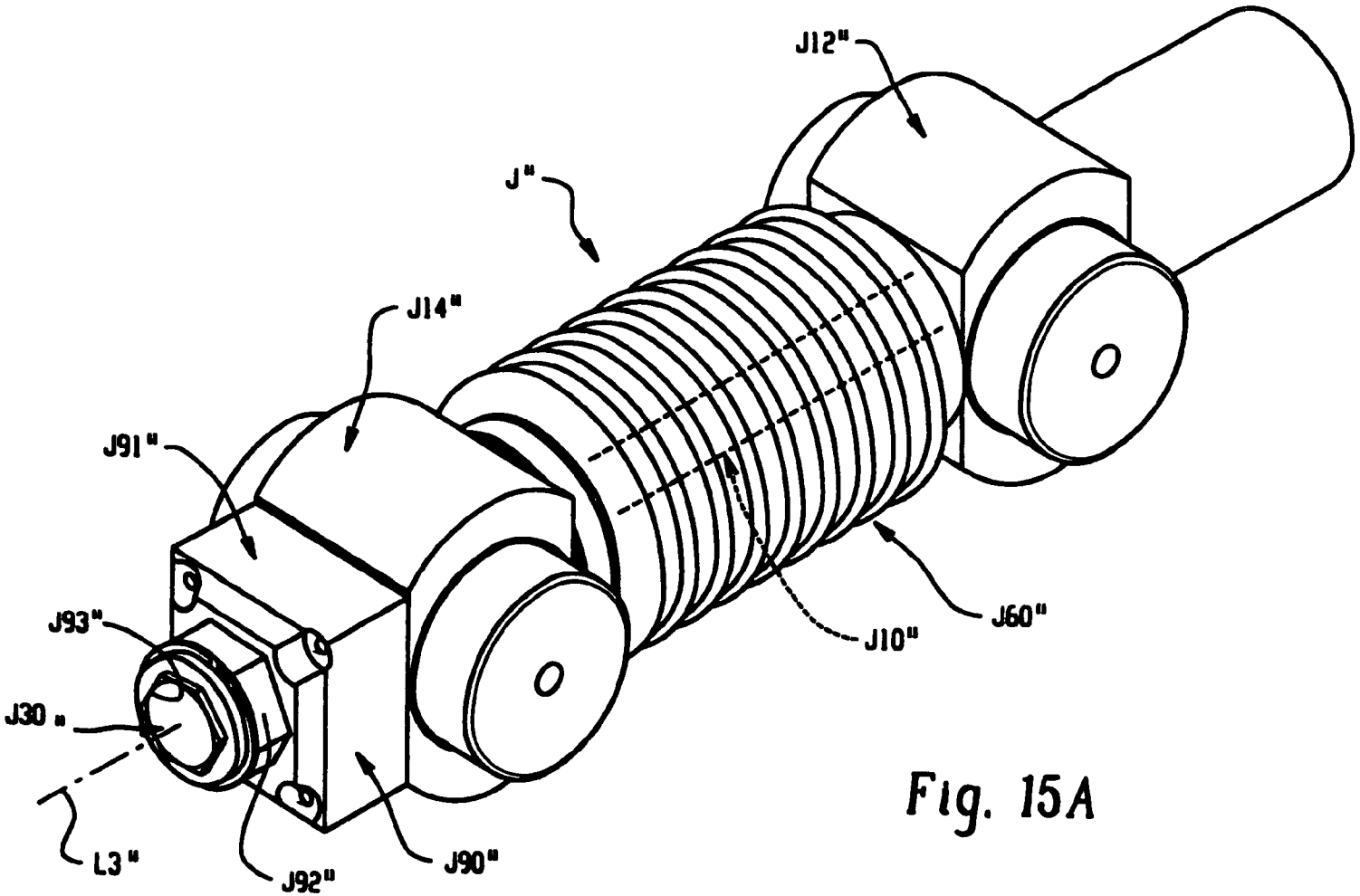
FIGS. 15A and 15B are isometric views of another alternative screw jack assembly formed in accordance with the present invention, with a screw lock assembly thereof in locked and unlocked conditions, respectively.
Figure 15B:
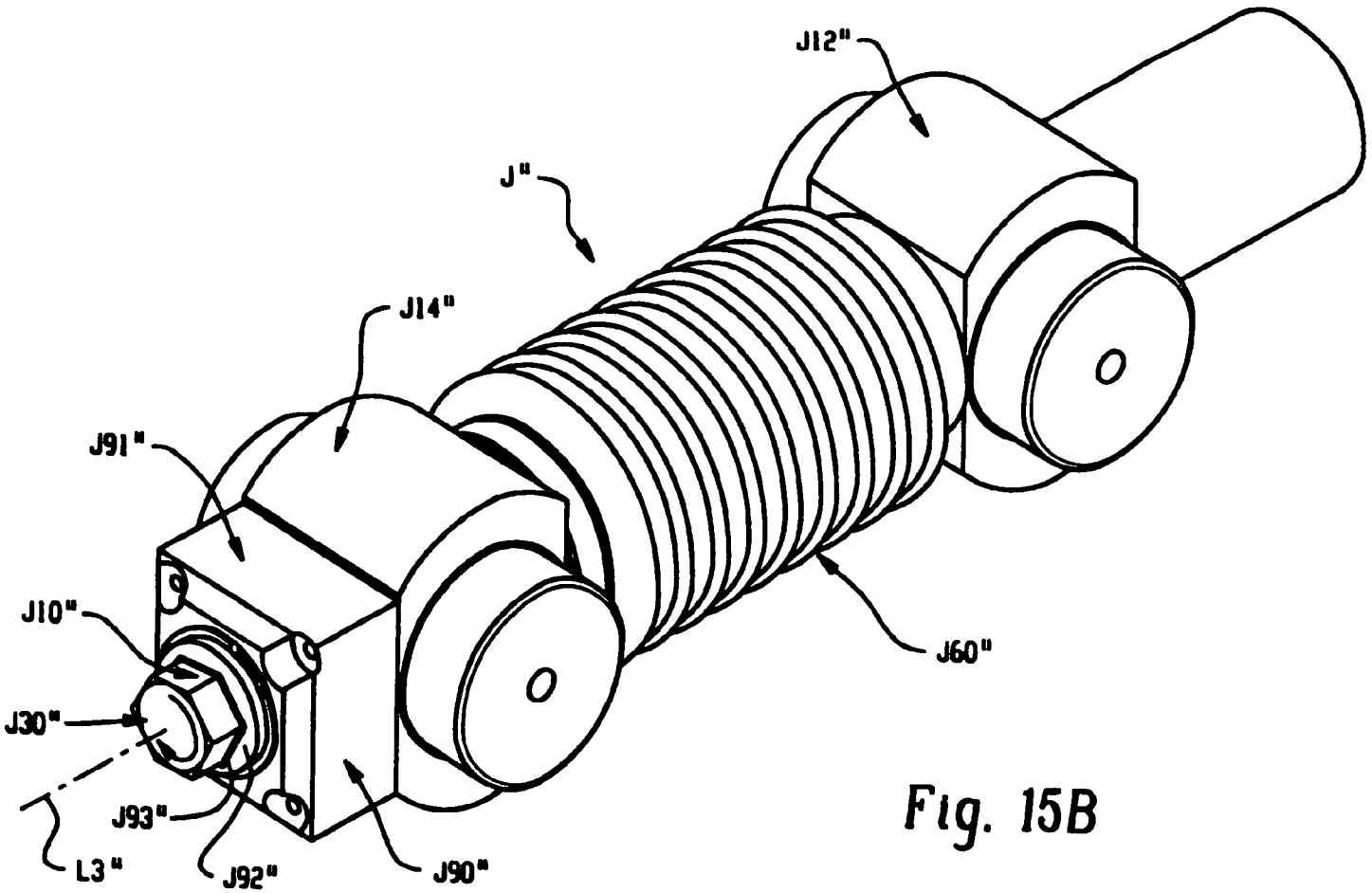

The coupler C,C' can alternatively include another embodiment of the screw jack assembly shown at J" in FIGS. 15A and 15B. The screw jack assembly J" is identical to the screw jack assembly J, except as otherwise shown and/or described herein. Accordingly, like components of the screw jack assembly J" relative to the screw jack assembly J are identified with like reference characters that include a double-primed (") suffix. New components are identified with new reference characters.

The screw jack assembly J" comprises a screw member J10" and first and second housing assemblies J12",J14". The first housing assembly J12" is preferably secured to the first hook assembly H1 and the second housing assembly J14" is preferably secured to the second hook assembly H2. The screw member J10" is threaded along at least a portion of its length and extends axially on an axis L3".

The screw jack assembly J" does not include the disc lock mechanism J50 described above. Instead, the screw jack assembly comprises a screw lock assembly J90". The screw lock assembly J90" is connected to the second housing assembly J14" and comprises a housing J91" through which the screw member J10" extends. The housing J91" comprises a lock sleeve J92" connected thereto that is adapted for selected movement between an extended position (FIG. 15A) and a depressed position (FIG. 15B). The lock sleeve J92" is spring-biased into the extended position and is non-rotatable. In the illustrated embodiment, the lock sleeve J92" defines a non-circular opening J93" that engages and prevents rotation of the non-circular head J30" of screw J10" when the sleeve J92" is extended as shown in FIG. 15A. Other non-rotatable engagements between the lock sleeve J92" and screw head J10" are contemplated and fall within the scope of the present development. Preferably, the opening J93" is conformed and dimensioned to closely mate with the polygonal head J30" of the screw J10". As such, when the lock sleeve J92" is extended, the screw J10" cannot rotate under load and/or due to vibration or other forces. On the other hand, when a tool such as a socket head or the like is mated with the head J30" of screw J10", the lock sleeve J92" is pushed into its depressed position (FIG. 15B) by the tool so that the head J30" of the screw J10" is disengaged therefrom and free to rotate. When the lock sleeve J92" is retracted, the screw head J30" is able to rotate so that the coupler C,C' can be expanded or contracted for coupling/decoupling operations as described above. When the tool is removed from the screw head J30", the lock sleeve J92" automatically resiliently moves to its extended or "locked" position as shown in FIG. 15A to prevent undesired rotation of the screw J10".

It is most preferred that the first hook assembly H1 be fixed relative to the ribs R1,R2 and that the second hook assembly H2 be movable relative to the ribs R1,R2 because the first hook assembly H1, which connects to a first or inner attachment pin P1, will typically encounter higher loads during digging and other operations as compared to the second hook assembly H2. Furthermore, as disclosed herein, it is preferred that the ears E1,E2 of the second hook assembly H2 pivot about the bosses S1*b*,S2*b* through which a pin-on pin PO2 passes so that the second hook assembly H2 pivots about the pin-on axis L2 (or stated another way, the second hook assembly H2 pivots about an axis coincident with the pin-on axis L2). This arrangement provides added strength relative to prior designs and minimizes pivot points. The fact that the ears E1,E2 of the second hook assembly H2 pivot about the pin-on axis L2 is also thought to be desirable to save space and provide a preferred geometry relative to prior spread-style couplers.

It is preferred that the first hook assembly H1 be permanently fixed in position relative to the ribs R1,R2 as by welding or the like as disclosed above. However, as used herein, the term "fixed" and other equivalent terms are intended to encompass any other arrangement where the first hook assembly H1 is made immovable relative to the first and second ribs R1,R2 during use of the coupler C,C'. Thus, for example, the term "fixed" as used herein is intended to encompass an arrangement wherein bolts or other fasteners or other means are used to secure the first hook assembly H1 immovably relative to the ribs R1,R2, even if the position of the first hook assembly H1 relative to the ribs R1,R2 is selectively adjustable when the coupler is not in use.

The size of the coupler C,C' will vary depending upon the machine to which it is to be connected and the size of the associated attachments to be operatively engaged by the coupler. For example, the width of the first hook FH and second hook SH can be set to a minimum width for a group or class of attachments. Thus, the coupler C,C' can be operatively coupled to all attachments in the class (spacers can be used between the opposite lateral sides of the hooks FH,SH and the attachment if needed).

Figure 16A:
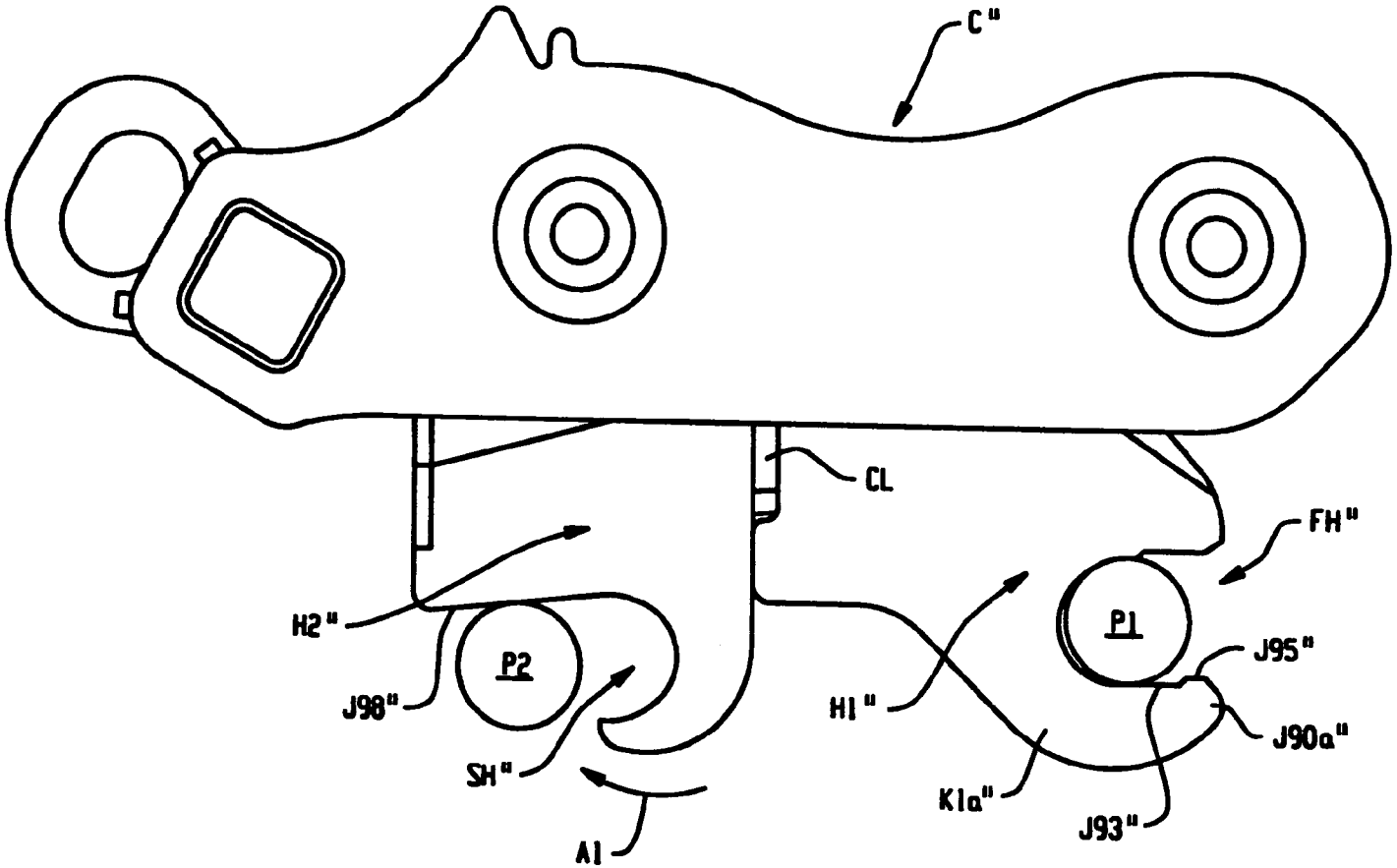
FIGS. 16A and 16B are side elevational views of another coupler formed in accordance with the present invention in collapsed and expanded conditions, respectively.
Figure 16B:
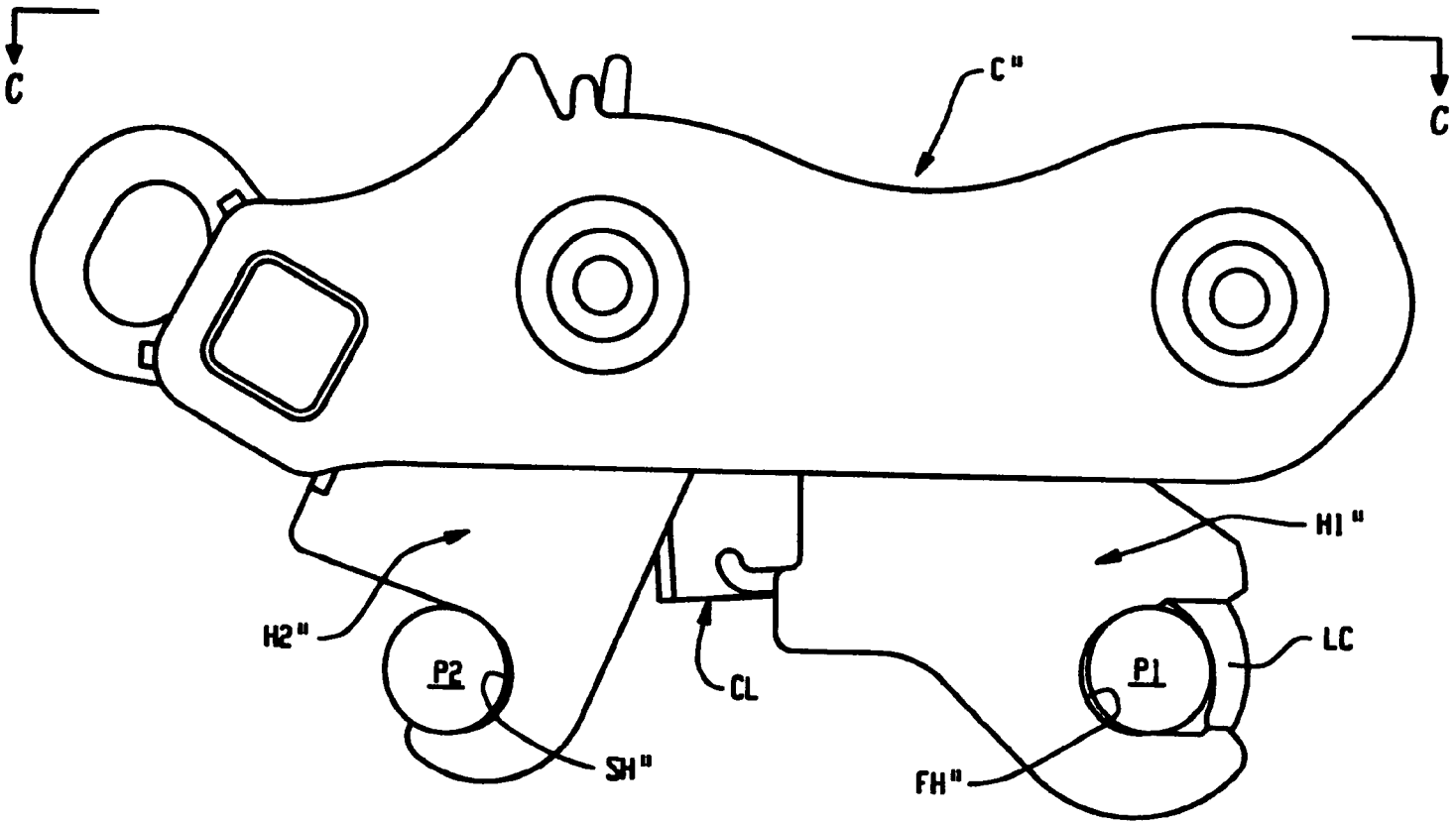
Figure 16C:
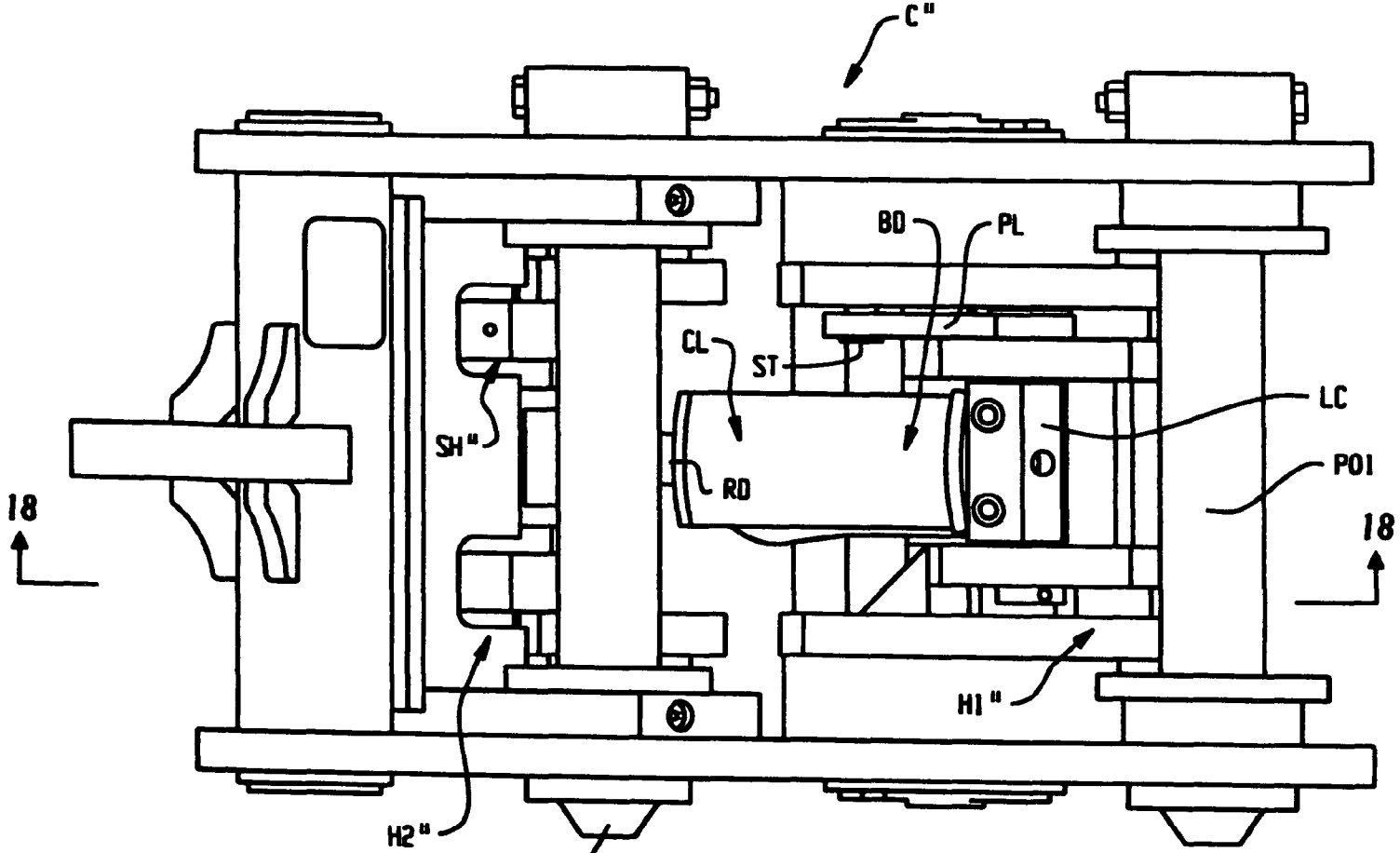
FIG. 16C is a top plan view of the coupler as taken along line C-C of FIG. 16B.

Those of ordinary skill in the art will recognize that the second hook assembly H2 can alternatively be pivotable about the first pin-on axis L1 without departing from the overall scope and intent of the present invention. Also, the second hook assembly H2 can be fixed and the first hook assembly H1 pivotable about either the first pin-on axis L1 or second pin-on axis L2. FIGS. 16A-16C illustrate a coupler C" that is identical to the couplers C,C' except as shown and/or described herein. As such, like components relative to the coupler C are identified with like reference characters including a double-primed (") suffix.

The coupler C" comprises a first hook assembly H1" comprising a first hook FH" and a pivoting second hook assembly H2" comprising a second hook SH" to receive and retain respective first and second attachment pins P1,P2 of a bucket or other attachment as described above. As best seen in FIGS. 16B and 16C, the coupler C" comprises an actuator such as a hydraulic or other fluid cylinder CL as shown or, alternatively, the actuator can comprise a screw jack J,J',J" or other means to spread and retract the second hook SH" relative to the first hook FH". With specific reference to FIG. 16C, the rod RD of the cylinder CL is preferably connected to the movable second hook SH" and the body BD of the cylinder CL is secured to a locking cam LC (of course, this arrangement of the cylinder CL can be reversed). As can be seen by comparing FIGS. 16A and 16B, when the rod RD of cylinder CL is retracted (FIG. 16A) into the body BD of the cylinder, i.e., when the actuator CL is operated into a retracted (first) configuration, the second hook SH" is moved inwardly toward the first hook FH" and the locking cam LC is retracted so as not to obstruct the first hook FH" to allow for coupling/decoupling operations with an attachment comprising first and second attachment pins P1,P2. On the other hand, when the rod RD of cylinder CL is extended relative to the body BD of the cylinder, i.e., when the actuator CL is operated into an extended (second) configuration, the second hook SH" is moved a maximum distance away from first hook FH" (as limited by the structure of coupler C" or the spacing of attachment pins P1,P2) and, when the second hook SH" can pivot no farther away from the first hook FH", the reaction force resulting from further attempted extension of cylinder rod RD causes the body BD of the cylinder CL to move the locking cam LC into an extended position where it at least partially and preferably completely obstructs the first hook FH" and captures the first attachment pin P1 therein (FIG. 16B). When the rod RD of cylinder CL is again retracted, the locking cam LC is pivoted to its retracted position and the second hook SH" is pivoted inwardly toward the first hook FH", in any sequence or simultaneously, to allow the attachment pins P1,P2 to be inserted/removed from the first and second hooks (FIG. 16A) for coupling/decoupling. Furthermore, it is preferred that a pilot check valve be used to ensure that the rod RD is retractable only upon the cylinder CL being actively pressurized in the orientation required to retract the rod RD to prevent retraction of the rod RD upon mere loss of hydraulic pressure due to a cut hose or the like.

Figure 17:
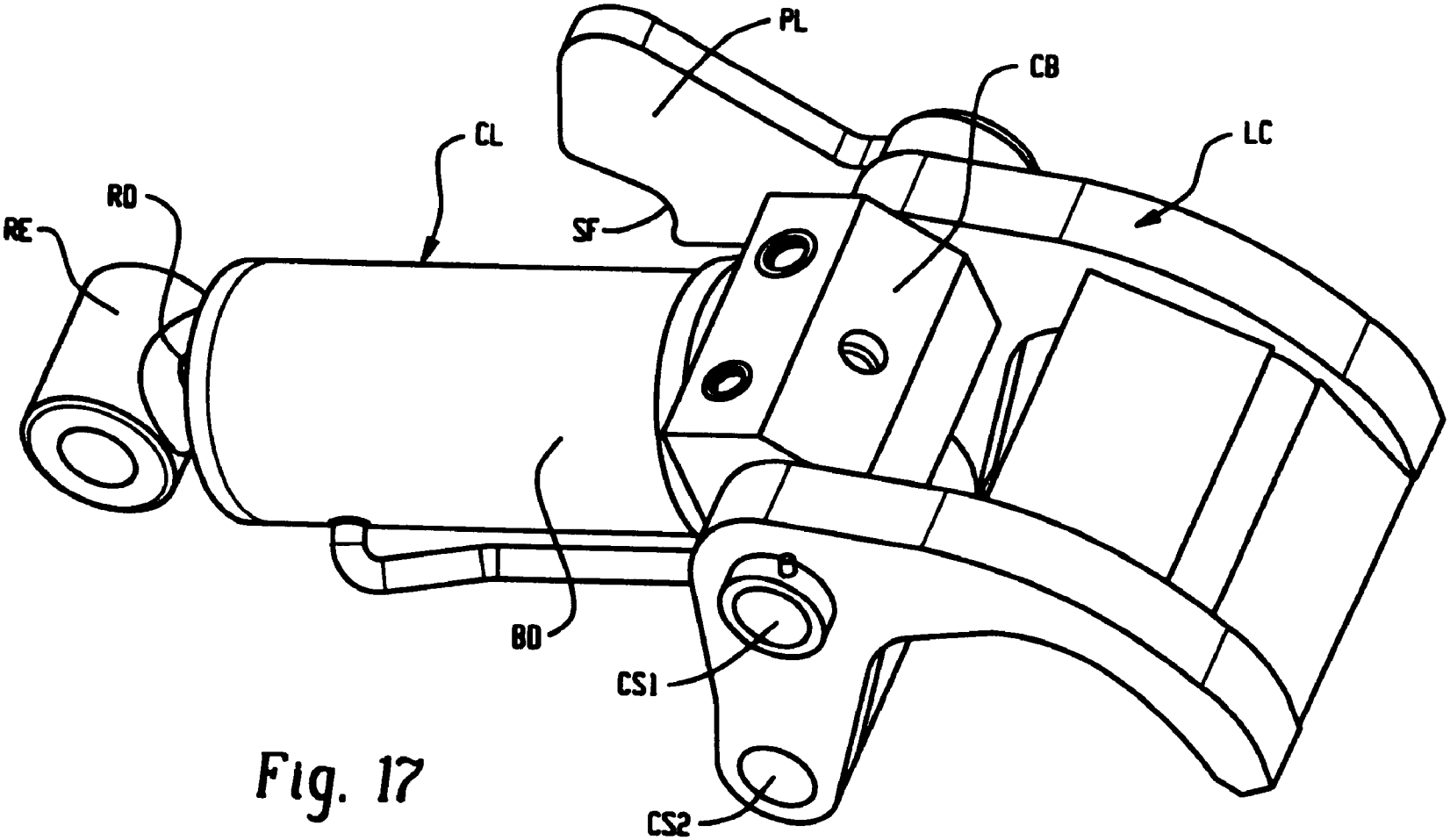
FIG. 17 is an isometric view of a cylinder and locking cam sub-assembly that forms a part of the coupler of FIGS. 16A-16C.

FIG. 17 illustrates the cylinder CL and locking cam LC subassembly. The rod RD comprises a rod eye RE for pivotal pin-on connection to the second hook assembly H2". The body BD comprises a base CB that is pivotally connected to the locking cam LC via first shaft CS1. The locking cam LC is pivotally connected to the first hook assembly H1" or an adjacent structure of the coupler C" via second shaft CS2 (see also FIGS. 18-20) for pivoting movement of the locking cam LC between its retracted and extended positions as shown in FIGS. 16A and 16B, respectively. A gravity operated pendulum lock bar PL is pivotally secured to the locking cam LC, preferably also via shaft first shaft CS1. The pendulum lock bar PL comprises or defines a stop face SF that selectively engages a stop ST to prevent unintended/unwanted movement of the locking cam LC from its extended position to its retracted position as described in full detail below.

Figure 18:
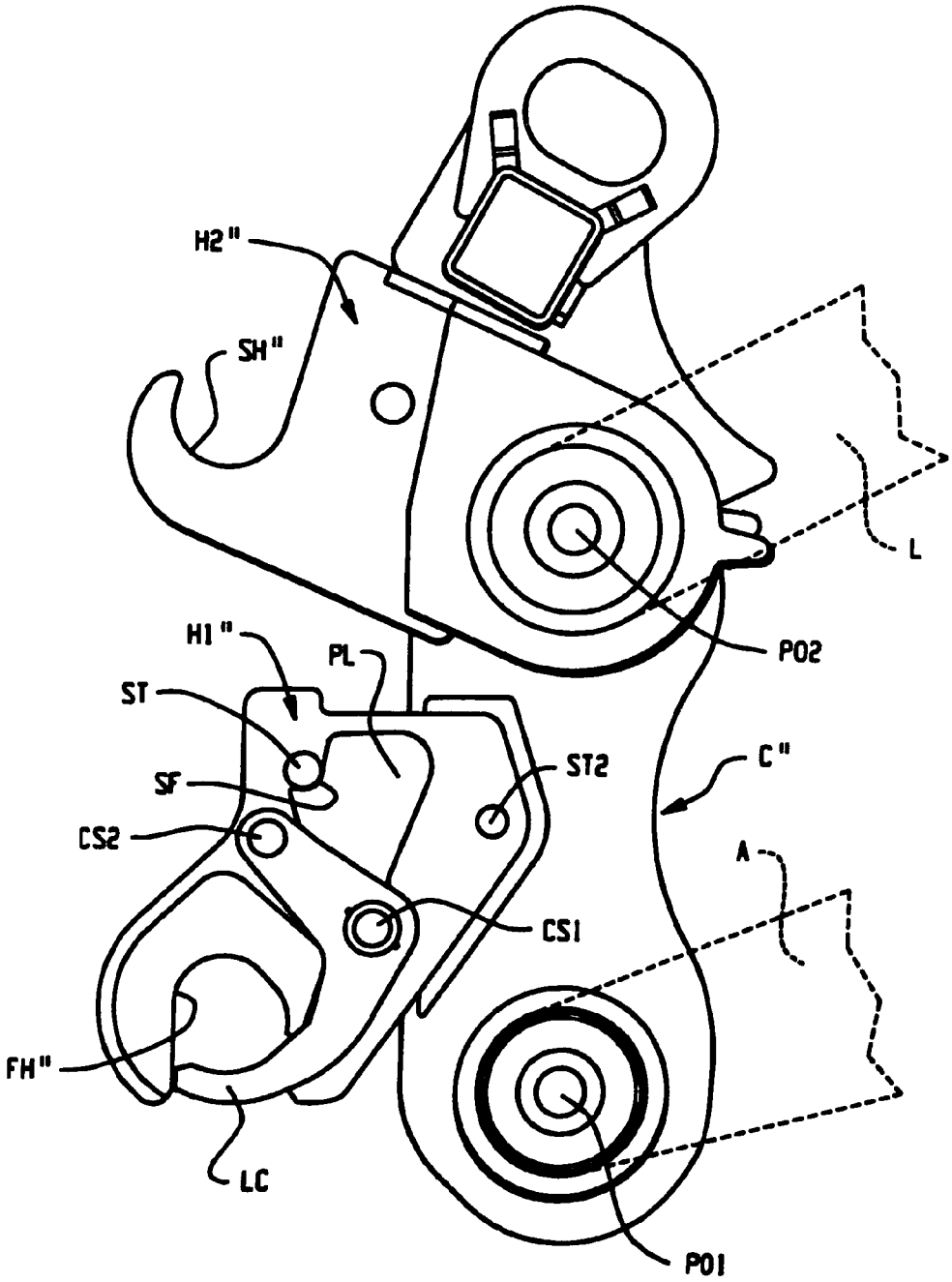
FIG. 18 is a simplified view as taken along line 18-18 of FIG. 16C, with the cylinder not shown to improve clarity, and showing the coupler operatively connected to an associated arm and control link and positioned in an extended or roll-back position, with the supplemental lock in a "locked" condition and with the second hook spread apart from the first hook.
Figure 19:
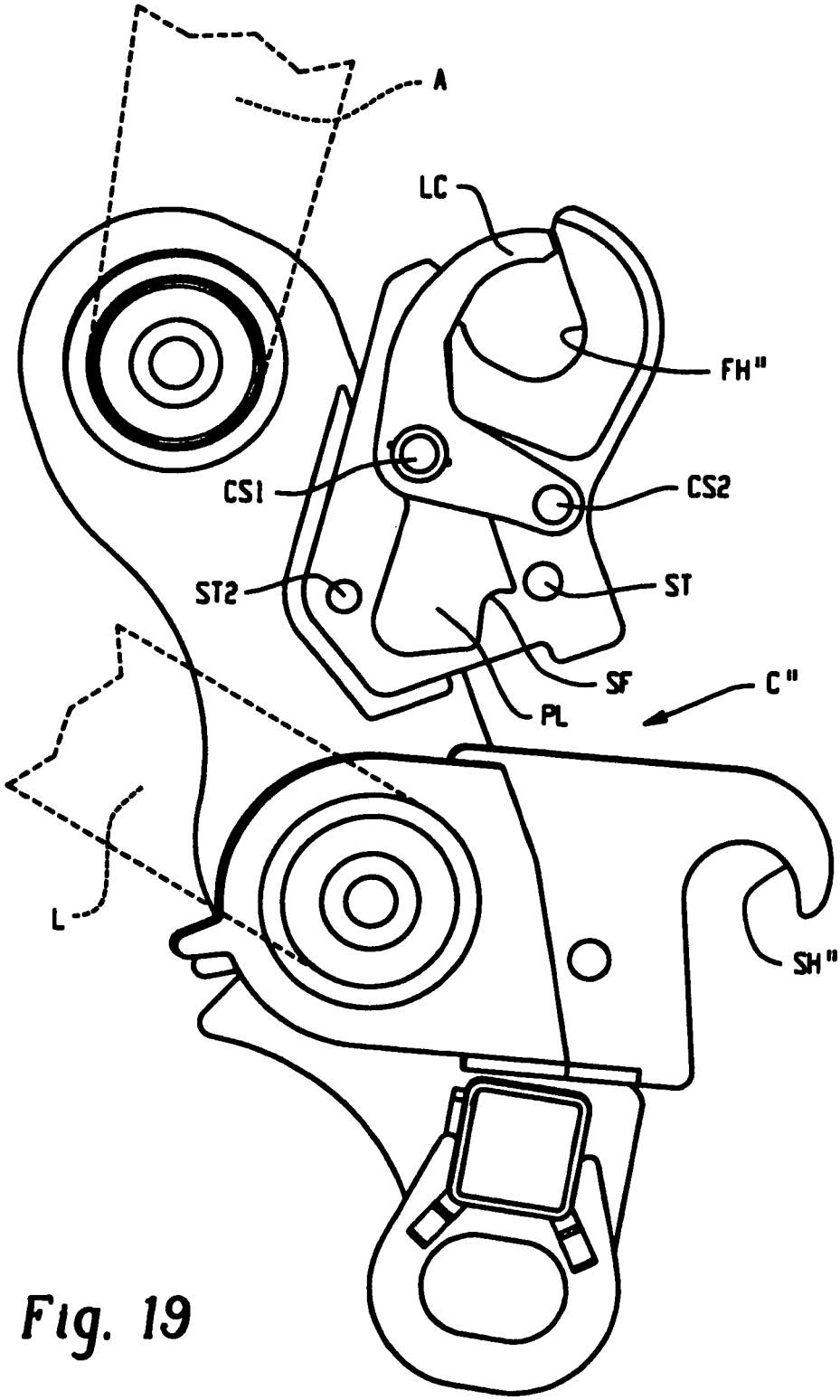
FIG. 19 is similar to FIG. 18, but shows the coupler in a curled or crowded position relative to the associated arm, with the supplemental lock in an "unlocked" condition due to pivoting under force of gravity; and, FIG. 20 is similar to FIG. 19, but shows the locking cam moved to its retracted position and shows the second hook retracted toward the first hook.
Figure 20:
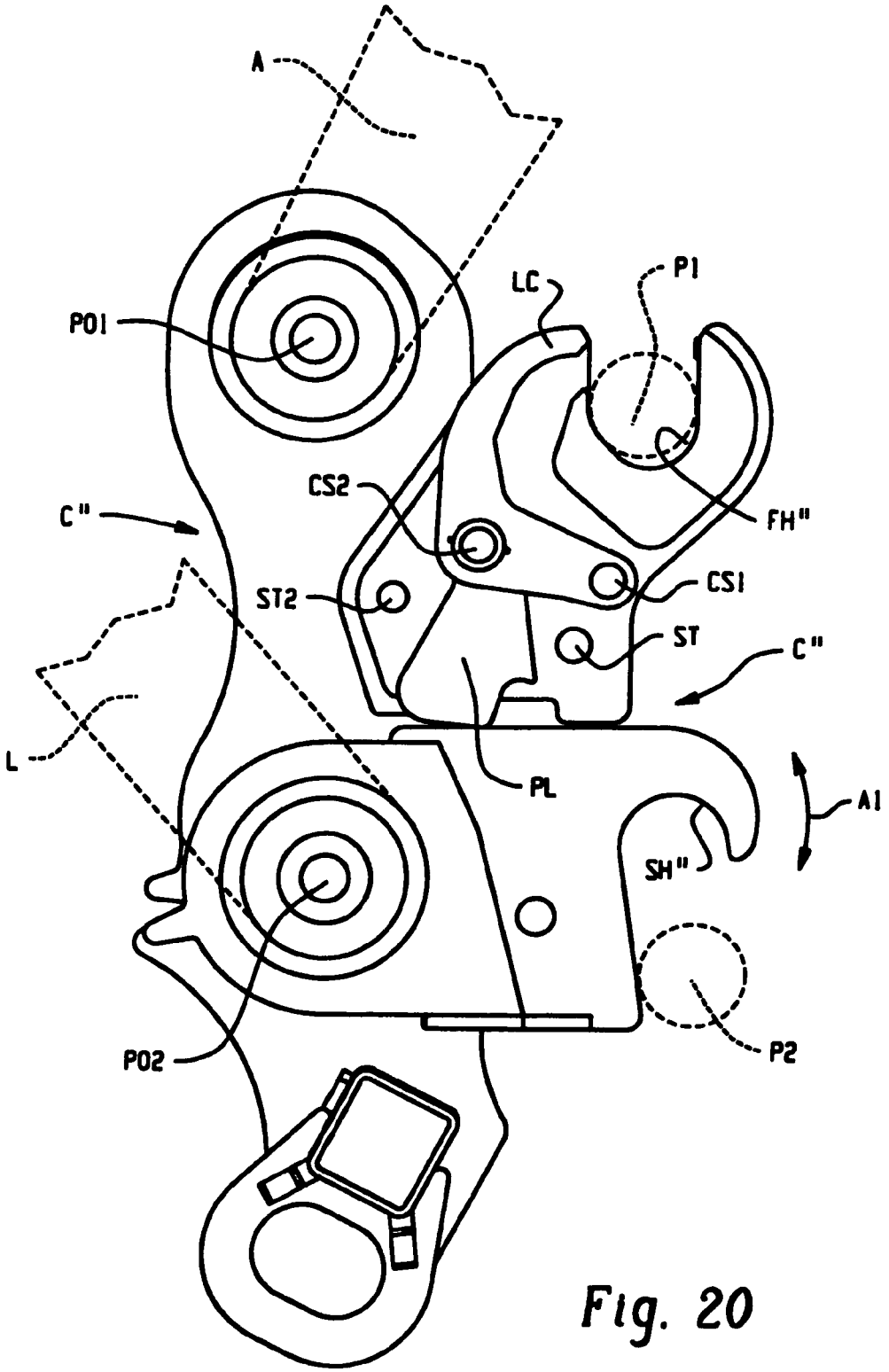

The structure and operation of the coupler C" can be further understood with reference to FIGS. 18-20. There, the cylinder CL is not shown to facilitate an understanding of the locking cam LC and pendulum lock bar PL. The coupler C" is operatively pinned to an arm A and control link L of an excavator or other machine. FIG. 18 shows the second hook SH" fully extended away from the first hook FH" for coupling to first and second attachment pins such as P1,P2. As noted, when the hooks FH",SH" are fully spread, continued actuation of the cylinder CL to extend the rod RD causes the cylinder body BD to urge and pivot the locking cam LC about shaft CS2 into its extended (pin-capturing) position where it at least partially obstructs the mouth of first hook FH" as shown in FIG. 18. The pendulum lock PL has no effect on movement of the locking cam into its extended position from its retracted position.

When the locking cam LC is extended, the pendulum lock bar PL is free to pivot relative to the locking cam LC under its own weight between a locked position (FIG. 18) and an unlocked position (FIG. 19) depending upon the angular orientation of the coupler C" relative to arm A. In the locked position of pendulum lock bar PL, as shown in FIG. 18, the stop face SF is aligned with and lies adjacent and/or abuts a stop ST connected to the first hook assembly H1 or other part of the coupler C" that is fixed in position relative to the moving locking cam LC so that the pendulum lock bar PL will prevent retraction of the locking cam LC owing to the abutment of the stop face SF with stop ST. In the unlocked position of pendulum lock bar PL, as shown in FIG. 19, the stop face SF is moved away from and out of alignment with the stop ST so that the locking cam LC is free to retract without interference between the pendulum lock bar and the stop.

More particularly, for safety reasons, the pendulum lock bar PL is weighted and pivoted to the locking cam LC in such a manner that when the locking cam LC is extended, the pendulum lock bar PL will remain in its locked position for all angular positions/orientations of the coupler C" relative to arm A except for one or more predefined "safe" positions where an attachment will not be dropped even if the first and second hooks FH",SH" are moved inward toward each other. In one preferred embodiment, the pendulum lock bar PL will remain in its locked position for all angular positions of the coupler C" relative to arm A except for the curled or "crowded" position where the coupler C" is pivoted inward underneath the arm A and the first hook FH" opens upwardly a sufficient degree so that an attachment pin P1 will be retained therein without regard to the position of the locking cam LC. This curled position is shown in FIG. 19 and, there, it can be seen that the stop face SF is moved away from the stop ST because the pendulum lock bar PL has swung by gravity to its unlocked position. In this position, the rod RD of cylinder CL can be retracted to draw the second hook SH" toward the first hook FH" and to retract the locking cam LC as shown in FIG. 20 while the first attachment pin P1 remains seated in first hook FH" so that, once the first and second hooks FH",SH" are close enough together, the attachment pins P1,P2 can be disengaged therefrom. Another "safe" position for the coupler C" is when the coupler is moved beyond a vertical plane into its extended/dump position, which would be the case if the coupler C" as shown in FIG. 18 is rotated clockwise or otherwise moved beyond vertical so that the pendulum lock bar PL will move rearward rotate under its own weight by gravity to its unlocked position and rest against a second stop ST2; this position is also "safe" because the second hook SH" would hold the attachment pin seated therein even if the second hook SH" is collapsed fully inwardly toward to the first hook FH".

The coupler C" also shows a variation in the profile of the first and second hooks FH",SH" which facilitates coupling operations for certain attachments. In particular, as shown in FIG. 16A, the first and second hooks FH",SH" are each defined with multiple arcuate pin seating surfaces defined by respective multiple radii as described above. However, for the second hook SH", the multiple arcuate pin seating surfaces are made tangent to the flat ramp surface J98" (FIG. 16A) while for the first hook FH" the multiple arcuate pin seating surfaces are made tangent to a flat surface J93" located inward from terminal end J90*a*". Also, the terminal end J90" of the first hook FH" comprises a raised bump J95" that projects outwardly therefrom to slightly impede outward movement of the associated attachment pin P1 when the second hook SH" is being coupled to a pin P2.

The development has been described with reference to preferred embodiments. The following claims are not limited to the preferred embodiments and are intended to be construed literally and/or according to the doctrine or equivalents to encompass modifications and alterations to the fullest possible extent.

The invention claimed is:

1. A coupler comprising:

an upper section including first and second spaced-apart ribs each defining first and second bores, said first bore of said first rib aligned with said first bore of said second rib on a first pin-on axis, and said second bore of said first rib aligned with said second bore of said second rib on a second pin-on axis;

a lower section including: (i) a first hook fixed in position relative to said upper section and adapted to receive a first associated attachment pin; and (ii) a second hook adapted to receive a second associated attachment pin, said second hook selectively movable relative to said upper section toward and away from said first hook;

a locking cam pivotally connected to said lower section, wherein said locking cam pivots relative to said first hook between a retracted position and an extended position, wherein said locking cam at least partially blocks said first hook when in said extended position;

an actuator including a first portion pivotally connected to said second hook and including a second portion pivotally connected to said locking cam, said actuator operable between a first position and a second position, wherein: (i) when said actuator is operated from said first position to said second position, said actuator moves said second hook away from said first hook and pivots said locking cam from said retracted position to said extended position; and, (ii) when said actuator is operated from said second position to said first position, said actuator moves said second hook toward said first hook and pivots said locking cam from said extended position to said retracted position;

a stop connected to said lower section in a fixed position; and, a pendulum lock bar pivotally connected to the locking cam, wherein said pendulum lock bar freely pivots by force of gravity between a locked position and an unlocked position in response to changes in an angular orientation of said coupler, wherein: (i) said pendulum lock bar is located to engage said stop when said actuator is operated from said second position toward said first position to prevent movement of said locking cam from said extended position to said retracted position when said pendulum lock bar is located in said locked position; and, (ii) said pendulum lock bar is moved out of alignment with said stop when said pendulum lock bar is located in said unlocked position so that said locking cam is movable from said extended position to said retracted position when said pendulum lock bar is in said unlocked position.

2. The coupler as set forth in claim 1, wherein said actuator is connected to said locking cam by a first shaft, and wherein said pendulum lock bar is pivotally connected to said locking cam by said first shaft.

3. The coupler as set forth in claim 2, wherein said locking cam is pivotally connected to said first hook by a second shaft.

4. The coupler as set forth in claim 1, wherein said stop is located adjacent said first hook.

5. The coupler as set forth in claim 1, wherein said actuator comprises one of: (i) a screw jack assembly comprising a rotatable screw member; and (ii) a hydraulic cylinder comprising a body and a rod that is selectively extensible from and retractable into said body under fluid pressure.

6. The coupler as set forth in claim 1, wherein said second hook comprises first and second ears that are pivotally connected to said first and second ribs, respectively.

7. The coupler as set forth in claim 6, wherein said first and second ears define first and second apertures that are rotatably supported on first and second bosses projecting from said first and second ribs, respectively.

8. A coupler comprising:

an upper portion defining a first pin-on axis and a second pin-on axis;

a lower portion including: (i) a first hook adapted to receive a first associated attachment pin, said first hook fixed in position relative to said upper portion; and (ii) a second hook adapted to receive a second associated attachment pin, said second hook movable relative to said upper portion toward and away from said first hook;

a locking cam pivotally connected to said lower portion and pivotable relative to said first hook between a retracted position and an extended position, wherein said locking cam at least partially blocks said first hook when in said extended position;

an actuator including a first portion operatively connected to said second hook and including a second portion operatively connected to said locking cam, said actuator being operable between a first position and a second position, wherein: (i) when said actuator is operated from said first position to said second position, said actuator moves said second hook away from said first hook and moves said locking cam from said retracted position to said extended position; and, (ii) when said actuator is operated from said second position to said first position, said actuator moves said second hook toward said first hook and moves said locking cam from said extended position to said retracted position;

a stop fixed in position relative to said lower portion; and, a pendulum lock bar pivotally connected to said locking cam and freely pivotable b between a locked position and an unlocked position depending upon an angular orientation of said coupler, said pendulum lock bar comprising a lock bar stop face, wherein:

(i) said lock bar stop face is located to engage said stop when said actuator is operated from said second position toward said first position to prevent movement of said locking cam from said extended position to said retracted position by interference between said stop and said lock bar stop face when said pendulum lock bar is located in said locked position; and, (ii) said lock bar stop face is moved out of alignment with said stop when said pendulum lock bar is located in said unlocked position so that said locking cam is movable from said extended position to said retracted position without interference between said stop and said lock bar stop face when said pendulum lock bar is in said unlocked position.

* * * * *